US011926445B2

(12) United States Patent
Galas, Jr.

(10) Patent No.: US 11,926,445 B2
(45) Date of Patent: Mar. 12, 2024

(54) SYSTEMS AND METHODS FOR FILLING CONTAINERS

(71) Applicant: Millennium Pharmaceuticals, Inc., Cambridge, MA (US)

(72) Inventor: Richard John Galas, Jr., Framingham, MA (US)

(73) Assignee: Millennium Pharmaceuticals, Inc., Cambridge, MA (US)

( * ) Notice: Subject to any disclaimer, the term of this patent is extended or adjusted under 35 U.S.C. 154(b) by 0 days.

(21) Appl. No.: 17/938,779

(22) Filed: Oct. 7, 2022

(65) Prior Publication Data

US 2023/0166877 A1 Jun. 1, 2023

Related U.S. Application Data

(62) Division of application No. 17/051,004, filed as application No. PCT/US2019/029722 on Apr. 29, 2019, now Pat. No. 11,498,708.

(Continued)

(51) Int. Cl.
*B65B 3/12* (2006.01)
*B65B 3/00* (2006.01)

(Continued)

(52) U.S. Cl.
CPC ..... *B65B 3/12* (2013.01); *B65B 3/003* (2013.01); *B65B 39/12* (2013.01); *B65B 57/145* (2013.01)

(58) Field of Classification Search
CPC .... B65B 3/04; B65B 3/12; B65B 3/26; B65B 3/003; B65B 39/12; B65B 57/145; B67C 3/007; B67C 3/12
See application file for complete search history.

(56) References Cited

U.S. PATENT DOCUMENTS 6,213,354 B1 * 4/2001 Kay ..... B01L 3/0262 222/14
6,599,476 B1 7/2003 Watson et al.
(Continued)

FOREIGN PATENT DOCUMENTS

CN 1668526 A 9/2005
CN 105142697 A 12/2015
(Continued)

OTHER PUBLICATIONS

European Patent Office, Partial Supplementary European Search Report for EP19792433.5, dated Dec. 10, 2021.
(Continued)

*Primary Examiner* — Timothy L Maust
(74) *Attorney, Agent, or Firm* — Womble Bond Dickinson (US) LLP

(57) ABSTRACT

Systems and methods for distributing a filling fluid are discussed. More particularly an exemplary filling system may include a reservoir holding a filling fluid for distribution. The filling system may also include a pump and filling nozzle fluidly coupled to the reservoir. A processor executes a filling module that when executed receives at least one input fluid property of the filling fluid and generates at least one set of operating parameters for controlling operation of the pump during a filling operation based at least in part on the fluid property. The generated set of operating parameters enable control of the pump to distribute the filling fluid through the filling nozzle, such that a fluid interface with a stable resting profile forms in the filling fluid in the filling nozzle adjacent to the nozzle opening after the filling fluid is distributed from the filling nozzle.

25 Claims, 11 Drawing Sheets

Related U.S. Application Data

(60) Provisional application No. 62/791,850, filed on Jan. 13, 2019, provisional application No. 62/663,927, filed on Apr. 27, 2018.

(51) Int. Cl.
*B65B 39/12* (2006.01)
*B65B 57/14* (2006.01)

(56) References Cited

U.S. PATENT DOCUMENTS

| | | | | |
|---|---|---|---|---|
| 7,749,553 | B2 | 7/2010 | Teichman et al. | |
| 7,997,304 | B2 | 8/2011 | Ranalletta et al. | |
| 8,273,307 | B2 * | 9/2012 | Eickhoff | G01N 35/10 422/520 |
| 8,293,521 | B2 * | 10/2012 | Hanafusa | B01L 3/502715 435/288.5 |
| 9,216,893 | B2 | 12/2015 | Chen et al. | |
| 9,399,215 | B2 * | 7/2016 | Cauley, III | B32B 38/0012 |
| 9,795,959 | B2 | 10/2017 | Leubbert et al. | |
| 10,578,634 | B2 | 3/2020 | Lehtonen et al. | |

FOREIGN PATENT DOCUMENTS

| | | | |
|---|---|---|---|
| CN | 105813942 | A | 7/2016 |
| EP | 3045187 | A1 | 7/2016 |
| JP | H02219702 | A | 9/1990 |
| JP | 2009-112674 | A | 5/2009 |
| JP | 4354522 | B1 | 10/2009 |

OTHER PUBLICATIONS

European Patent Office, Supplementary European Search Report for EP19792433.5, dated Apr. 26, 2022.
World Intellectual Property Organization, International Search Report for PCT/US2019/029722, dated Jul. 19, 2019.
Written Opinion issued in connection with corresponding International Application No. PCT/US2019/029722 dated Oct. 27, 2020.

* cited by examiner

SYSTEMS AND METHODS FOR FILLING CONTAINERS

CROSS-REFERENCE TO RELATED APPLICATIONS

This application is a divisional application of U.S. patent application Ser. No. 17/051,004, filed Oct. 27, 2020, which is a U.S. National Phase Under 35 U.S.C. § 371 of International Application No. PCT/US2019/029722, filed Apr. 29, 2019, which claims priority to U.S. Provisional Application No. 62/791,850, filed on Jan. 13, 2019, and U.S. Provisional Application No. 62/663,927, filed on Apr. 27, 2018, the contents of which are hereby incorporated by reference in their entireties.

TECHNICAL FIELD

The present disclosure relates to systems and methods for filling containers, such as pre-filled syringes.

BACKGROUND

Filling systems are often used to fill large numbers of relatively small containers, such as pre-filled syringes, with fluid from a relatively large reservoir. The filling system includes a pump fluidly coupled to the reservoir and to one or more filling nozzles. In large filling systems, the pump may connect to tens, or even hundreds, of filling nozzles to simultaneously fill a large number of individual containers with fluid from the reservoir. The pump may be automatically controlled by a controller to dispense fluid from the reservoir to individual containers through the filling nozzle (s).

SUMMARY

Embodiments of the present invention provide systems and methods that account for certain fluid dynamic behaviors in order to distribute filling fluid through a filling nozzle to a container in a manner that increases filling accuracy and prevents blockages. More particularly, embodiments distribute filling fluid in a manner that avoids overfilling and under filling containers while also accounting for fluid dynamic behaviors to avoid an unwanted drying of filling fluid within the filling nozzle that may lead to blockages or contamination. The systems and methods herein may be used for repetitive, accurate, high throughput manufacturing of combination pharmaceutical products, such as pharmaceutical liquids in delivery devices.

In one exemplary embodiment disclosed herein, a filling system includes: a reservoir holding a filling fluid for distribution; at least one filling nozzle fluidly coupled to the reservoir to distribute the filling fluid through a nozzle opening, a pump fluidly coupled to the reservoir and at least one filling nozzle configured to distribute the filling fluid through the filling nozzle and the nozzle opening; and at least one processor operatively coupled to the pump and a memory having a filling module stored therein. The at least one processor is configured to execute the filling module to: receive at least one fluid property of the filling fluid; generate, based at least partially on the at least one fluid property, at least one set of operating parameters for distributing the filling fluid through the nozzle opening such that a fluid interface with a stable resting profile forms in the filling fluid in the filling nozzle adjacent to the nozzle opening after the filling fluid is distributed from the at least one filling nozzle; and output the at least one set of operating parameters. The at least one set of operating parameters enables control of the pump to distribute the filling fluid through the nozzle opening during a filling procedure.

In another exemplary embodiment disclosed herein, a filling system includes a reservoir holding a filling fluid for distribution and at least one filling nozzle fluidly coupled to the reservoir to distribute the filling fluid through a nozzle opening defining a nozzle radius (r). A stable fluid interface forms in the filling fluid adjacent to the nozzle opening after the filling fluid is distributed from the at least one filling nozzle. The stable fluid interface has a static interface and/or a controlled plug volume In another embodiment a processor-implemented method of distributing a filling fluid from a reservoir holding the filling fluid to a container using at least one pump and at least one filling nozzle fluidly connected to the reservoir is disclosed. The at least one filling nozzle includes a nozzle opening and is configured to deliver the filling fluid through the nozzle opening to a container. The method includes receiving via an input mechanism an input specifying at least one fluid property of the filling fluid; generating, based at least partially on the at least one fluid property, at least one set of operating parameters for controlling the pump during a filling procedure to distribute the filling fluid through the nozzle opening such that a fluid interface with a stable resting profile forms in the filling fluid in the filling nozzle adjacent to the nozzle opening after the filling fluid is distributed from the at least one filling nozzle; and outputting the at least one set of operating parameters. The at least one set of operating parameters enables control of the pump to distribute the filling fluid through the nozzle opening during a filling procedure.

BRIEF DESCRIPTION OF THE FIGURES

The foregoing and other objects, features and advantages of the exemplary embodiments will be more fully understood from the following description when read together with the accompanying drawings, in which.

DETAILED DESCRIPTION

Embodiments of the present invention provide systems and methods for filling containers with filling fluid through a filling nozzle in ways that increase filling accuracy and prevent material blockages. More particularly, embodiments inhibit filling fluid flow towards the bottom of the filling nozzle where the fluid may impact filling accuracy by overfilling, or drip from the nozzle resulting in under filling. Additionally fluid at the end of the nozzle may dry within the filling nozzle causing a blockage. The filling fluid defines a density ($\rho$), a fluid surface tension ($\gamma$), and a net acceleration (a). Accordingly, in some embodiments, the filling system has a processor and a memory holding a filling module that, upon execution by the processor, generates one or more sets of operating parameters based on at least one input fluid property of the filling fluid. The one or more sets of operating parameters enable control of a pump, to distribute the filling fluid through the filling nozzle, in a manner that forms a fluid interface with a stable resting profile within the filling nozzle after the filling fluid is distributed from the filling nozzle.

Figure 1:
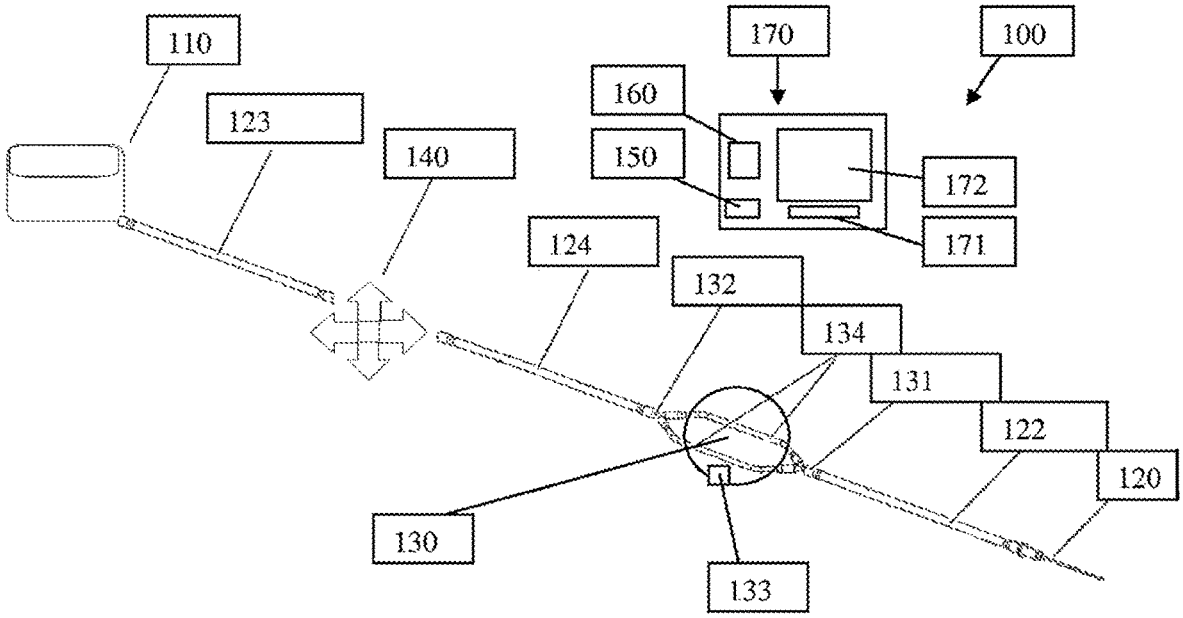
FIG. 1 is a partial schematic view of an exemplary embodiment of a filling system.
Figure 2:
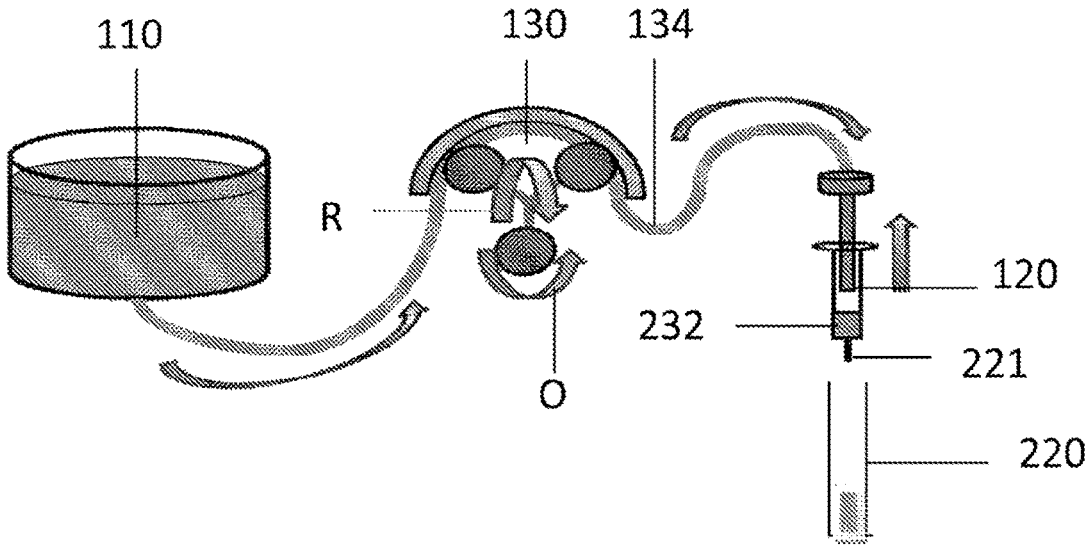
FIG. 2 is a cross-sectional view of an exemplary pump and filling nozzle filling a container with filling fluid.

Referring now to the drawings, and more particularly FIGS. 1-2, an exemplary embodiment of a filling system 100 is illustrated. The filling system 100 includes a reservoir 110, shown as a break tank, holding a filling fluid for distribution to containers, such as, but not limited to, vials, cartridges, syringes and pre-filled syringes. At least one filling nozzle 120, shown as a filling needle, is fluidly coupled to the reservoir 110 to distribute the filling fluid through a nozzle opening 221 (shown in FIG. 2) formed in the filling nozzle 120. A pump 130 is fluidly coupled to the reservoir 110 and the filling nozzle 120 to force the filling fluid through the nozzle opening 221 from the reservoir 110 and distribute the filling fluid through the nozzle opening 221. In some embodiments, the filling nozzle 120 fluidly couples to the reservoir 110 through the pump 130 via nozzle tubing 122 fluidly coupled to a first connector 131 of the pump 130, shown as a Y-connector. The pump 130 may fluidly couple to the reservoir 110 via a first tubing 123 coupling the reservoir 110 to a distributor 140, shown as a four-way distributor, and a second tubing 124 fluidly coupling the distributor 140 to a second connector 132 of the pump 130, also shown as a Y-connector. The tubing 122, 123, 124 in the system 100 may comprise silicone or other materials and have variable tubing diameters, depending on the filling fluid being distributed and the desired filling rate.

The filling system 100 includes a processor 150 operatively coupled to the pump 130 and a memory 160. The memory 160 has a filling module stored therein, which is executed by the processor 150 and described further herein. The filling module may include one or more software components, programs, applications, or other units of code base or instructions configured to be executed by one or more processors including processor 150. In some embodiments, the processor 150 and the memory 160 are part of a computing device 170 that also includes an input 171, such as a keyboard, touchscreen, etc., for inputting data to the filling module. In some embodiments, the computing device 170 includes a display 172 operatively coupled to the processor 150 to display graphics for controlling functions of the filling system 100, as will be described further herein. The processor 150 may operatively couple to the pump 130 by a wireless or wired connection, either directly or indirectly through a network. In some embodiments, the processor 150 operatively couples to multiple pumps through a router or similar element to control multiple pumps simultaneously. In some embodiments, the pump 130 includes a pump memory 133 that stores pump operating instructions that originate from, for example, the processor 150.

Referring specifically now to FIG. 2, the pump 130 and filling nozzle 120 are illustrated in greater detail. The pump 130 is illustrated as a peristaltic pump that rotates to dispense the filling fluid through pump tubing 134 fluidly coupled to both the first connector 131 and the second connector 132 to pump filling fluid to the filling nozzle 120 for filling a container 220, shown as a syringe reservoir. In some embodiments, the pump 130 is configured to rotate in one direction, illustrated as arrow R, to distribute filling fluid through the filling nozzle 120 and rotate in an opposite direction, illustrated as arrow O, to pull filling fluid back into the filling nozzle 120. Such a feature is commonly known as a reverse flow or "suck-back" feature to pull drops of filling fluid, such as drop 232, back into the filling nozzle 120, and will be described further herein. While the pump 130 is illustrated as a peristaltic pump, other types of pumps, such as rotary pumps, may also be included in the filling system 100.

In one exemplary embodiment, an exemplary pump head for a peristaltic pump has a diameter of 60 mm and consists of three evenly spaced 10 mm cams per fluid path. The pump tubing follows the pump head for 130-140°. The degrees of rotation around the pump head in combination with the tubing ID (which indicates the tube internal diameter) determines the amount of fluid dispensed. The tubing ID thus determines the volume in one revolution. The larger the ID, the more fluid is dispensed per revolution. As a result, the same pump parameters can result in different flow rates when different tubing diameters are used. Exemplary parameters which can be programmed are outlined in the table below.

Pump Head Parameters

| Parameter | Range | Units | Explanation |
|---|---|---|---|
| Velocity | 0-1200 | RPM | Revolutions per minute of the cams |
| Acceleration | 0-15 | 1 = 6,667 RPM/s | Forward (filling) acceleration to velocity |
| Deceleration | 0-20 | 1 = 6,667 RPM/s | Forward (filling) deceleration to zero |

-continued

| Parameter | Range | Units | Explanation |
|---|---|---|---|
| Suckback/ Reverse | 0-90 | degrees | Degrees of counter rotation |
| Reverse Acceleration | 0-20 | 1 = 6,667 RPM/s | Reverse acceleration rate |

It should be appreciated that the fluid impact of these parameters at the filling nozzle/needle is also a function of a filling nozzle/needle ID internal diameter indicative of filling nozzle/needle diameter (the larger the ID, the slower the fluid velocity is per revolution), pump tubing ID, and number of fluid paths/pump head and that the described pump parameters are added only for illustration purposes. Embodiments of the present invention are not limited to the described parameters and pumps and other operating characteristics should be considered to be within the scope of the present invention.

Figure 3:
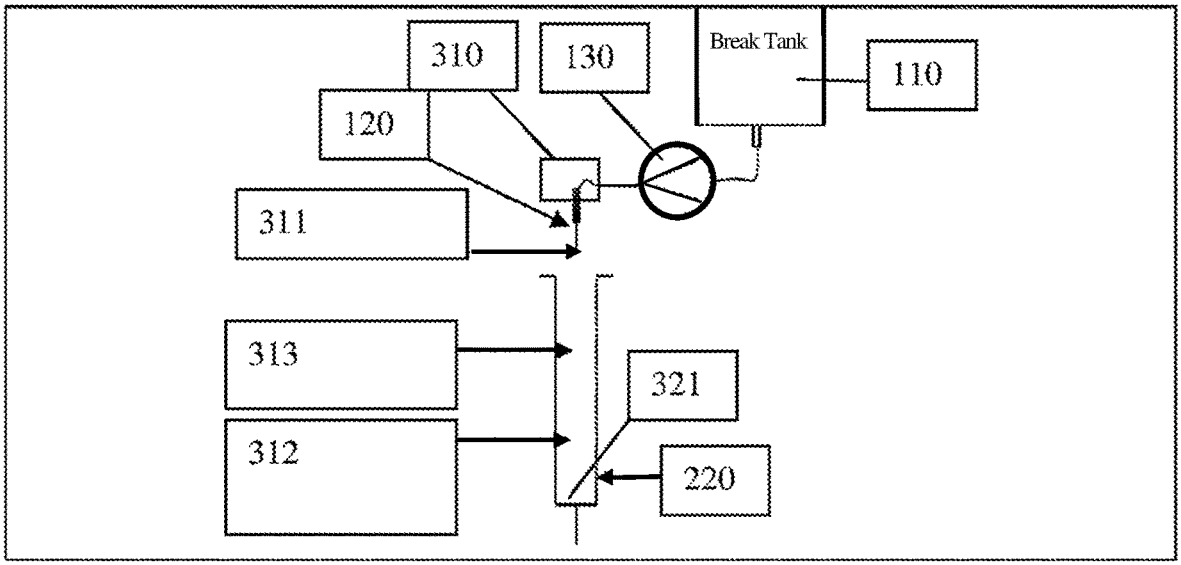
FIG. 3 is a schematic view illustrating movement of the filling nozzle shown in FIG. 2 at various points during a filling procedure.

In some embodiments, and referring now to FIG. 3, the filling nozzle 120 is moved by a nozzle actuator 310, which is also operatively coupled to the processor 150, to different positions within the container 220 during filling. The nozzle actuator 310 may start, for example, at an initial filling position 311 above the container 220. When the filling procedure starts, the nozzle actuator 310 moves the filling nozzle 120 to an initial fill point 312 within the container 220 that is a closest point to a closed end 321 of the container 220 that the filling nozzle 120 will reach while filling the container 220. As the filling fluid from the reservoir 110 fills the container 220 through the filling nozzle 120, the nozzle actuator 310 raises the filling nozzle 120, relative to the closed end 321 of the container 220. The nozzle actuator 310 raises the filling nozzle 120 within the container 220 to a final fill point 313 within the container 220. Once the filling procedure ends and the container 220 is filled with the filling fluid, the nozzle actuator 310 moves the nozzle actuator 310 back to the initial filling position 311 above the container 220, allowing an empty container to take the place of the now-full container 220 for filling by the filling system 100.

Processor 150 may execute the filling module stored in the memory 160 to operate various elements of the filling system 100, such as the pump 130 and the nozzle actuator 310, to automatically fill empty containers with filling fluid from the reservoir 110 in accordance with identified operating parameters as described herein. In some embodiments, the filling module is operatively coupled to other elements, such as a container conveyor, that move containers for filling to a filling position under the filling nozzle 120 and nozzle actuator 310 prior to starting the filling procedure. Once the container is in the filling position, the filling module outputs one or more signals to the nozzle actuator 310 to lower the filling nozzle 120 into the container 220 and to the pump 130 to rotate so filling fluid is distributed from the nozzle opening 221 into the container. During the filling procedure, the filling module can also signal the nozzle actuator 310 to raise the filling nozzle 120, as previously described.

After the container 220 is filled with the fluid, the filling module may signal the pump 130 to perform the suck-back function to pull back any remaining filling fluid from the nozzle opening 221 into the filling nozzle 120 in order to prevent drips from the nozzle opening 221. The filling module may also signal the nozzle actuator 310 to return to the initial filling position 311 and the container conveyor to move anew container to the filling position before restarting the filling procedure. The filling procedure can be repeated in a loop as necessary until, for example, the reservoir 110 is empty or a desired number of containers have been filled with the filling fluid.

Various operating parameters of conventional filling systems lead to waste of filling fluid and inconsistent filling of containers during the filling procedure. For example, filling fluid sometimes drips from the filling nozzle 120 and is wasted during the period between the filled container leaving the filling position and a new container moving to the filling position.

Figures 4A, 4B, 4C:
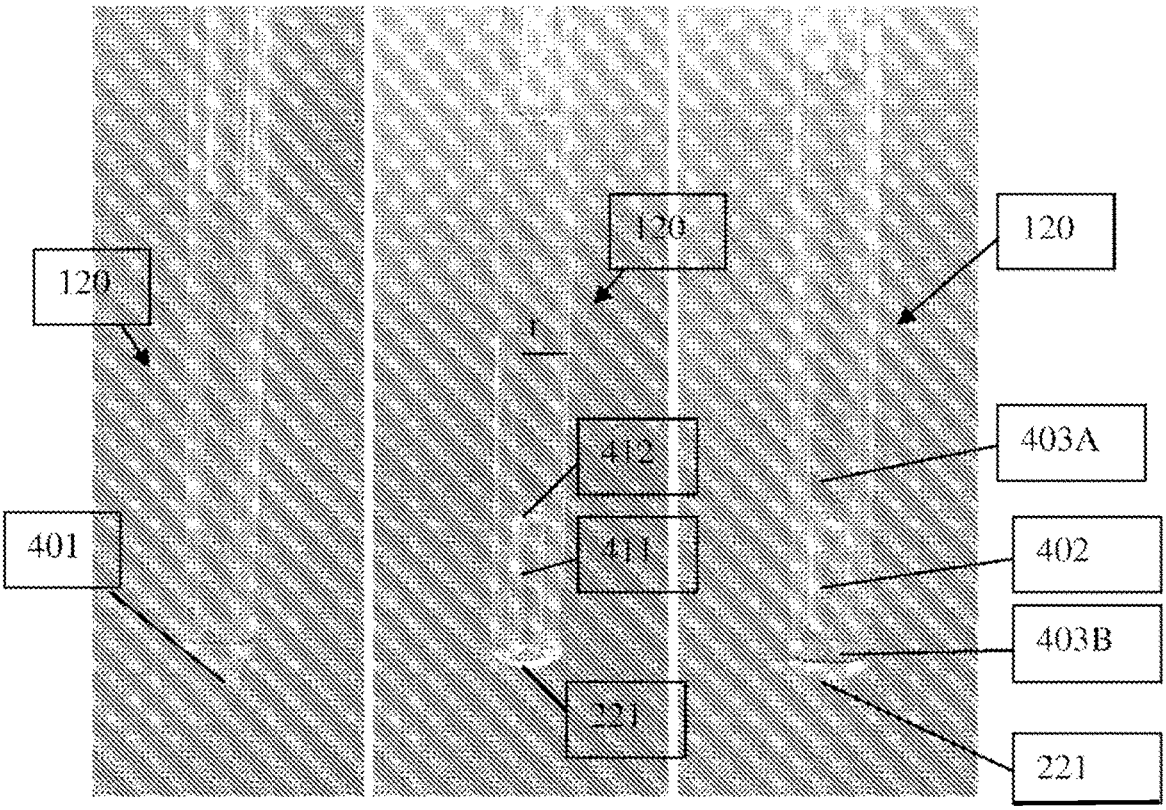
FIG. 4A is a side view of a capillary tube, such as a filling nozzle, illustrating a liquid drip.
FIG. 4B is a side view of a capillary tube, such as a filling nozzle, illustrating a liquid plug forming in the tube.
FIG. 4C is a side view of a filling nozzle illustrating a formed bubble with a stable liquid interface to inhibit dripping and plug formation in an exemplary embodiment.

A liquid drop 401 at the end of the filling nozzle 120 is illustrated in FIG. 4A. While this drip waste may be tolerable for inexpensive filling fluids, certain filling fluids, such as biologic-based drug products, have become so expensive that drip waste from multiple filling nozzles 120 in the filling system 100 adds up to significant revenue losses. Further, splashing of the filling fluid in the container as the filling fluid leaves the filling nozzle 120 can lead to an underfill of the container. When the filling fluid is a drug product going into a pre-filled syringe, even a relatively small underfilling of the pre-filled syringe can be grounds for the pre-filled syringe being rejected for distribution, e.g., due to risk of providing a low dose to the patient.

To address drip waste, the previously described suck-back function can be performed at the end of the filling procedure while a new container moves to the filling position. The suck-back function pulls liquid droplets that may form at the nozzle opening 221 back into the filling nozzle 120 to reduce drip waste. While the suck-back function reduces drip waste, it is not completely effective to eliminate drip waste.

Use of the suck-back function can also have drawbacks. When the suck-back function is used, air can enter the filling nozzle 120 and form a bubble 402 within the filling nozzle 120, as shown in FIG. 4B. The bubble 402 separates the liquid within the filling nozzle 120 into a first portion 403A on one side of the bubble 402 and a second portion 403B on the opposite side of the bubble 402 adjacent to the nozzle opening 221.

While the second portion 403B can be a non-trivial amount of filling fluid that will be distributed into a container when the container is filled, a bigger issue arises when operation of the filling system 100 is interrupted for as little as two minutes. As can be appreciated from FIG. 4B, the second portion 403B of filling fluid is exposed to the environment outside the filling nozzle 120. When the second portion 403B of the filling fluid sits in the filling nozzle 120 for two minutes or more as may happen in conventional systems, the second portion 403B of the filling fluid can dry and form a solid plug within the filling nozzle 120, especially when the filling fluid has a significant amount of dissolved solid active ingredient, such as one or more proteins, in a carrier fluid. When the filling system 100 attempts to resume filling containers, the formed plug of solid material may clog the filling nozzle 120 and disrupt operation of the filling system 100, leading to further stoppage of the filling system.

Alternatively, an additional issue presents in a conventional system as the first portion 403A of filling fluid distributed from the filling nozzle 120 may dissolve the formed film to carry the solid active ingredient into the container being filled. This may significantly increase the amount of active ingredient distributed into the container.

Because drug product dosages are subject to strict regulations concerning fill accuracy compared to the advertised dosage, having an increased amount of active ingredient in a pre-filled syringe is also grounds for rejecting a pre-filled syringe for distribution and represents significant product waste.

Attempts to address the previously described issues have focused on trial and error tests to find suitable operating parameters of filling systems. While the trial and error tests have produced some improvements to operation of filling systems, such testing does not address the underlying causes of the specific issues. Thus, extensive trial and error testing was needed to determine acceptable operating parameters of a filling system whenever a new filling fluid was to be distributed from the filling system. Trial and error testing is also time-consuming and expensive. Trial and error testing not only requires a significant amount of time to determine acceptable operating parameters, but also has other requirements adding to the expense such as formulating surrogate fluids, a filling system "test setup," etc.

To address issues of waste drips and inconsistent fill volume during the filling procedure, and referring now to FIGS. 1 and 4C, the filling system 100 disclosed herein is configured to account for the fluid dynamic behaviors that cause drips and inconsistent filling. Referring specifically to FIG. 4C, it has been discovered that formation of a fluid interface, which may be a bubble 411, with a stable resting profile adjacent to the nozzle opening 221 of the filling nozzle 120 provides a stable fluid interface 412 that inhibits droplet formation of the filling fluid outside the filling nozzle 120, as illustrated in FIG. 4A, and also inhibits formation of the solid plug within the filling nozzle, as illustrated in FIG. 4B. In some embodiments, the stable fluid interface 412 may be part of a fully formed, i.e., closed, bubble or a partially formed, i.e., open to the atmosphere, bubble. Essentially, the bubble 411 has a sufficient length to keep the filling fluid from dripping from the nozzle opening 221 while not having an excessive length that would result in the formation of a significant liquid plug within the filling nozzle 120 at the nozzle opening 221. Thus, when the bubble 411 with the stable resting profile is formed adjacent to the nozzle opening 221, the filling fluid within the filling nozzle 120 resists drying within the filling nozzle 120 and dripping from the nozzle opening 221 because filling fluid is stably held within the filling nozzle 120 and resists evaporation of the fluid component. In one embodiment, the filling fluid has a fluid profile that minimizes mass loss due to convective drying, by producing a stable resting profile which has been retracted from the opening of the filling needle. In one embodiment the amount of retraction is dependent on the surrounding environment fluid, e.g., air, flow around the filling nozzle.

To form the bubble 411 with the stable resting profile, it was discovered that various fluid properties of the filling fluid and operating parameters of the filling system 100 may be controlled. The bubble 411 with the stable resting profile can be achieved if the Bond number ($B_o$) of the filling fluid in the filling nozzle 120 is less than a value of 0.842, even if the bubble is not a fully formed bubble. It should be appreciated that a Bond number of 0.842 of the filling fluid in the filling nozzle represents a theoretical limit above which the profile is not stable but that Bond values only slightly exceeding 0.842 may still provide a useful bubble in some circumstances.

Operating parameters of the filling system 100 to keep the Bond number (which is also sometimes referred to as the Eötvös number)) (ratio of gravitational force tension force) less than the critical value can be determined by the equation $$\frac{\rho g r^2}{\gamma} < 0.842,$$

where ρ is a density differential of the filling fluid relative to the surrounding environment fluid (e.g., air, inert gas, oil, alcohol), g is the net acceleration of the fluid (equal to the acceleration of gravity when the filling nozzle 120 is not moving), r is a radius of the filling nozzle 120 (shown in FIG. 4), and γ is a fluid surface tension of the filling fluid relative to the surrounding environment fluid. For ease of description, it is assumed herein that the surrounding environment fluid is air with a negligible effect on the density differential and the fluid surface tension of the filling fluid. In certain scenarios where the filling procedure takes place in an environment where the surrounding environment fluid has a non-negligible effect on the density differential and the fluid surface tension of the filling fluid, the effect of the surrounding environment fluid may need to be taken into account.

Because the density differential (ρ) for a specific filling fluid will generally be constant regardless of the operating parameters of the filling system 100, the net acceleration of the filling fluid, the radius r of the filling nozzle 120, and fluid surface tension between the filling fluid and the filling nozzle 120 can represent controllable parameters to achieve a Bond number value of less than 0.842. The fluid surface tension of the filling fluid may be altered, for example, by adjusting the fluid surrounding the filling nozzle, i.e. the surrounding environment fluid 120, as described previously, which will affect the fluid surface tension of the filling fluid. In some exemplary embodiments, the fluid surface tension of the filling fluid may be controlled by, for example, assuming the material of the filling nozzle 120 will not change, i.e., the fluid surface tension of the filling fluid is also a constant. In some embodiments, the filling nozzle 120 may comprise a metal material such as stainless steel. As used herein, the density of the filling fluid and the fluid surface tension may each be referred to as a "fluid property" of the filling fluid and may be provided or measured according to methods known in the art. Other fluid properties of the filling fluid may include, but are not limited to, viscosity, compressibility, etc.

When the fluid surface tension is assumed to be constant, the only variables to control are the net acceleration of the filling fluid and the radius r of the filling nozzle 120, which may be referred to as operating parameters of the filling system 100 that are distinct from the fluid properties of the filling fluid. In some exemplary embodiments, the net acceleration of the filling fluid and the radius r of the filling nozzle 120 can be controlled to satisfy the equation $(g*r^2) < (0.842*\gamma/\rho)$. The net acceleration of the filling fluid may be, for example, the net acceleration as a result of gravity acting on the filling fluid and an opposing acceleration due to the reverse flow/suck-back function of the pump 120, movement of the filling nozzle 120 and filling fluid by the nozzle actuator 310, or any combination of those forces. In some exemplary embodiments, a material of the filling nozzle 120, which may be stainless steel or plastic, may also be an operating parameter of the filling system 100 as the composition of the filling nozzle or coating thereon may affect the fluid velocity.

Figure 7:
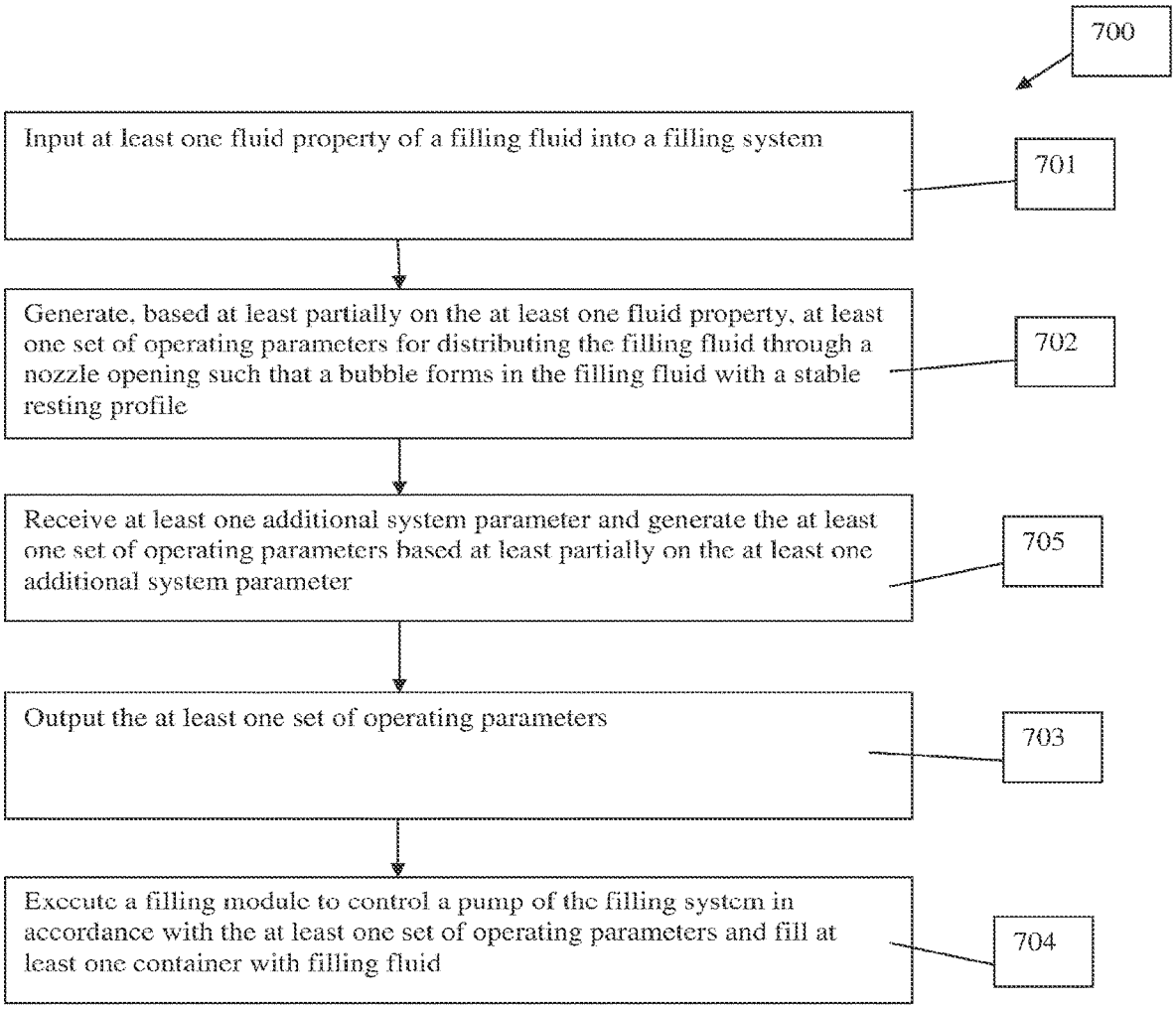
FIG. 7 is a flow chart illustrating an exemplary sequence of steps for operating a filling system in an exemplary embodiment.

To operate the filling system 100, and referring now to FIG. 7, the processor 150 is configured to execute the filling module stored in the memory 160 to perform a method 700 that includes steps 701, 702, and 703 and, in some embodiments, steps 704, 705, and 706. Step 701 includes inputting at least one fluid property of the filling fluid into the filling system 100. In some embodiments, the at least one fluid property is the density of the filling fluid, as previously described, and is input into the computing device 170 through the input 171, which may be a keyboard. In some embodiments, the fluid property is not directly input by a user into the filling module, but is received by the filling module from a database, which may be stored in the memory 160 or communicated to the filling module from another element. For example, the user may select a graphic shown on the display 172 corresponding to a particular fluid, with the filling module then querying the memory 160 to pull one or more fluid properties of the selected fluid from a database stored in the memory 160 for input into the filling module.

Step 702 includes generating, based at least partially on the at least one fluid property, at least one set of operating parameters for distributing the filling fluid through the nozzle opening 221 such that a bubble with a stable resting profile forms in the filling fluid in the filling nozzle 120 adjacent to the nozzle opening 221 after the filling fluid is distributed from the filling nozzle 120. In some embodiments, the set of operating parameters can be generated to establish a Bond number below the critical value of 0.842, as previously described. For example, generating the one or more sets of operating parameters may be based on the input of one or more fluid properties to identify a range of pump and other operating parameters needed to establish a Bond number less than 0.842. In some embodiments, the filling module is configured to establish a Bond number indirectly from certain fluid properties or operating parameters. For example, a mass and volume of the filling fluid may be input to the filling module, which can then determine the density of the fluid as part of establishing a Bond number below the critical value. In another embodiment, the density of the filling fluid may be input directly to the filling module.

In some embodiments, one or more operating parameters can also be input to the filling module to reduce the number of variable operating parameters that are adjustable. For example, the radius r of the filling nozzle 120 may be input as a constant, with the filling module then generating one or more sets of operating parameters based on the radius r being held constant. In such a scenario, the one or more sets of operating parameters may include possible materials such as, but not limited to, plastic, stainless steel, or coatings or constructs thereon, of the filling nozzle 120 that may be used (to control the fluid surface tension) and operating parameters that affect the net acceleration of the filling fluid. In some embodiments, the at least one set of operating parameters may include only a single variable, such as a reverse flow velocity, which may be referred to as a "suck-back velocity." of the pump 130, to establish a Bond number below the critical value of 0.842. It should thus be appreciated that generating the at least one set of operating parameters can be varied in many different ways depending on the at least one fluid property input into the filling system 100 and the operating parameter(s), if any, that are held constant. For example, when surface tension is input as a fluid property, the system uses the Bond number relationship to determine the density, and then calculates a design space from those two values.

Step 703 includes outputting the at least one set of operating parameters. The set of output operating parameter(s) enable control of the pump 130 when distributing the filling fluid through the nozzle opening 120 during a filling procedure, such as the previously described filling procedure. In some exemplary embodiments, the set of operating parameters includes, at least, pump operation parameters for the pump 130 including, for example, a forward rotation velocity, a suck-back velocity for the suck-back function, acceleration (forward/reverse), deceleration (forward/reverse), timing parameters for activation of the pump 130, etc. In some embodiments, the set(s) of operating parameters include nozzle movement parameters for the nozzle actuator 310 including, for example, a movement speed of the nozzle actuator 310 to carry the filling nozzle 120, timing parameters for activation of the nozzle actuator 310, diving needle motion, etc. Other operating parameters that may be controlled include a diameter of the filling nozzle 120, a filling nozzle composition, etc. It should thus be appreciated that the output set(s) of operating parameters may be output to enable automatic control of some, or all, components of the filling system 100 to fill containers such that a bubble with a stable resting profile is formed in the filling fluid after distributing the filling fluid when, for example, there is an interruption in the filling procedure. Alternatively, the output set(s) of operating parameters may be displayed to a user for manual control of some, or all, components of the filling system 100.

In some exemplary embodiments, the generated set(s) of operating parameters are output to assist in choosing operating parameters of the filling system 100. For example, the set(s) of operating parameters may be output to the display 172 of the computing element 170 for displaying visual elements that signify the generated operating parameters. Such output may be required, for example, when the filling system 100 has certain parameters controlled by the filling module, such as parameters of the pump 130 and the nozzle actuator 310, and other parameters that must be manually adjusted, such as the radius r and composition of the filling nozzle 120, which may be adjusted by manually replacing the filling nozzle 120. In some embodiments, the filling module only generates and outputs the at least one set of operating parameters but does not control other functions of a filling system. For example, the filling module may output the set(s) of operating parameters to a different computing device at a remote location via a network, or otherwise, to enable control of an off-site pump or other components of a filling system. It should therefore be appreciated that the filling system 100 may include multiple processors.

Step 704 includes the processor 150 executing the filling module to control the pump 130 in accordance with the at least one set of operating parameters and fill at least one container, such as the container 220, with the filling fluid. In some embodiments, the filling module continuously controls the pump 130 during the filling procedure. In some embodiments, the filling module outputs a portion or an entirety of the set(s) of operating parameters to the pump 130, which then automatically operates according to the operating parameters until instructed otherwise by the filling module. Similarly, the filling module may output a portion or an entirety of the set(s) of operating parameters to the nozzle actuator 310, which may be continuously controlled by the filling module or operate automatically according to the operating parameters until instructed otherwise by the filling module. While the pump 130 and the nozzle actuator 310 are described as receiving the operating parameters and being controlled by the filling module, it should be appreciated that other components of the filling system 150, such as the container conveyor, may also be controlled by the filling module in a similar fashion.

Step 705 includes receiving at least one additional system parameter and generating the at least one set of operating parameters based at least partially on the at least one additional system parameter. In some embodiments, the at least one additional system parameter is one or more operating parameters of the filling system 100, such as the radius r of the filling nozzle 120, the composition of the filling nozzle 120, a net acceleration of the filling nozzle 120 and filling fluid during the filling procedure, etc. In some embodiments, the at least one additional system parameter is a different parameter that affects operation of the filling system 100, such as a model of the pump 130 and/or composition of one or more of the tubings 122, 123, 124, etc. For example, the model of the pump 130 may affect the possible suck-back velocities that can be achieved by the filling system 100 during operation and affect other operating parameters of the system. Thus, it should be appreciated that the at least one additional system parameter, while not directly affecting fluid motion in the filling fluid, has an impact on the possible operating parameters that can be generated. It should be further appreciated that many different additional system parameters can be received for use in generating the at least one set of operating parameters.

As previously described, forming the bubble 411 with a stable resting profile in the filling fluid in the filling nozzle inhibits dripping of the filling fluid from the nozzle opening 221 and drying of the filling fluid within the filling nozzle 120. However, forming the bubble 411 with the stable resting profile only acts to keep a liquid plug from expanding during rest, such as when the filling system 100 is not operating. A liquid plug may still form in the filling nozzle 120 during the suck-back function due to the bubble 411 (or stable fluid interface 412) rising slightly faster than the filling fluid during the suck-back. This disparity in the rising speed of the bubble compared to the filling fluid results in some filling fluid escaping the bubble 411 and forming a film on the wall of the filling nozzle 120, which may dry and form a relatively small liquid plug.

Figure 8:
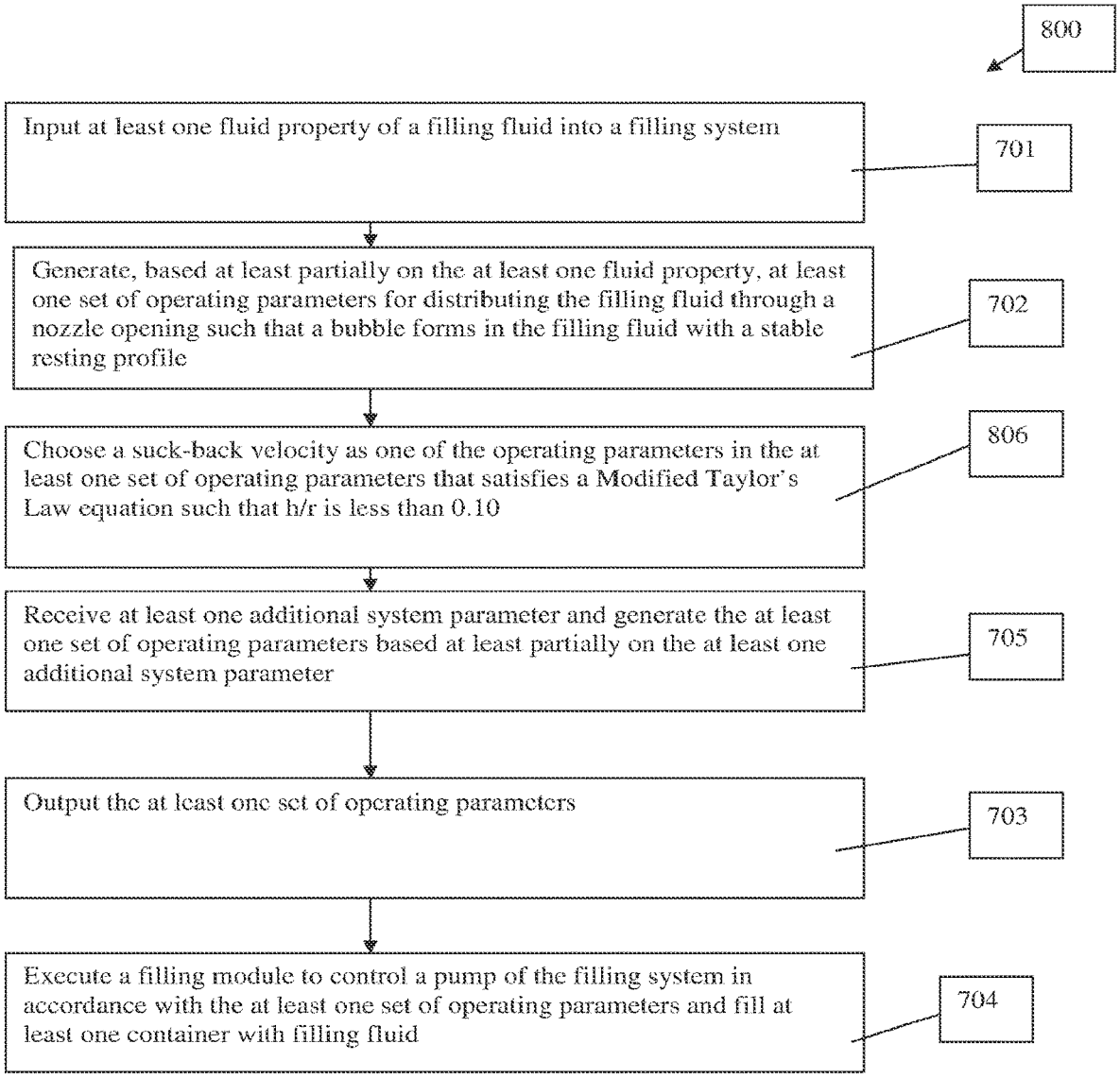
FIG. 8 is a flow chart illustrating another exemplary sequence of steps for operating a filling system in an exemplary embodiment.

FIG. 8 describes a method 800 for operating the filling system 100 to minimize the thickness of the film. The method 800 includes steps 701, 702, and 703 of the method 700, and in some embodiments includes steps 704 and 705, and also includes additional step 806. Step 806 includes choosing a suck-back velocity as one of the operating parameters in the at least one set of operating parameters that satisfies a Modified Taylor's Law equation of $$\frac{h}{r} = \frac{1.34 * Ca^{2/3}}{1 + 1.34 * 2.5Ca^{2/3}}$$

such that h/r is less than a predetermined maximum value where $$Ca = \frac{\mu V}{\gamma},$$

h/r is a thickness of a formed film within the filling nozzle 120 divided by the radius of the filling nozzle 120, μ is a viscosity of the filling fluid, V is a velocity of the filling fluid, and γ is the fluid surface tension. The predetermined maximum value of h/r can depend on the acceptable variability of the filling procedure, e.g., the maximum allowed overfill or underfill of the filling fluid into a container or the minimum volume of a formed plug that clogs the filling nozzle 120. The volume of a formed plug may be calculated as an annulus volume, which is equal to an integration of h/r multiplied by a suck-back height of the filling fluid. In some embodiments, the predetermined maximum value of h/r is between 0.01 and 0.05. In some embodiments, the predetermined maximum value of h/r is less than 0.10, such as less than 0.05.

In some embodiments, the velocity of the filling fluid is the suck-back velocity and is the only operating parameter in the Modified Taylor's Law equation that may be adjusted by the filling module. In some embodiments, the filling module outputs the at least one set of operating parameters that both establishes a Bond number less than the critical value of 0.842 ("Condition 1") and also satisfies the Modified Taylor's Law equation such that h/r is less than the predetermined maximum value ("Condition 2"), corresponding to a formed film thickness that is 10% or less of the radius r of the filling nozzle 120. It should be appreciated that the illustrative thickness limit of 10% is not absolute and the thickness limit can be driven by either acceptable variability in the fill (from a safety or efficacy perspective) and/or a limitation on the duration of the filling process. In some embodiments, the at least one set of operating parameters is a range of operating parameters that can be varied within the range to satisfy both Condition 1 and Condition 2 simultaneously, allowing the filling system 100 to fill containers such that the bubble with a stable resting profile is formed adjacent to the nozzle opening 221 and a thin film thickness develops within the filling nozzle 120 following filling fluid distribution. The filling module may also receive one or more additional system parameters, as previously described, and generate the at least one set of operating parameters satisfying both Condition 1 and Condition 2 simultaneously based at least partly on the received one or more fluid property and one or more additional system parameters.

In some embodiments, the filling nozzle 120 may be a tapered nozzle with a first radius and a second radius that is smaller than the first radius and is adjacent to the nozzle opening 221. In some embodiments, the filling nozzle 120 has a narrowed portion with the second radius. The narrowed portion may be between a body of the filling nozzle 120, which has the first radius, and the nozzle opening 221, which also has the first radius so as to provide a narrower portion or other constriction at bottom of the filling nozzle above the nozzle opening. Such an embodiment may have the narrowed portion for an air interface formed in the filling nozzle 120, while the first radius of the nozzle opening 120 and body of the filling nozzle reduces the risk of the thin film explained by the Modified Taylor's Law equation from fully clogging the filling nozzle 120.

In some embodiments, the composition of the filling nozzle 120 is selected to control a contact angle θ between the filling fluid and the filling nozzle 120. When the contact angle θ is relatively high, i.e., close to or greater than 90°, behavior of the filling fluid within the filling nozzle 120 may change. The change in behavior of the filling fluid was observed by Alexandru Herescu in a thesis entitled "Two-Phase Flow in Microchannels. Morphology and Interface Phenomena," published by the Michigan Technological University in 2013 (hereafter "Herescu"), which is incorporated herein by reference in its entirety. For example, a high contact angle θ may induce the formation of a non-wetting film, as shown by Herescu, in addition to a "Bretherton film" formed adjacent to the meniscus due to shock that occurs in the fluid at high fluid velocities, e.g., high suck-back velocities. At very high fluid velocities, multiple plugs may be formed in the filling fluid, as shown by Herescu. Thus, in some embodiments, one controlled parameter of the filling system 100 is the composition of the filling nozzle 120 to control the contact angle θ formed between the filling nozzle 120 and the filling fluid. A high contact angle results in hydrostatic jumps and thicker films. Accordingly, in some embodiments a contact angle that is less than 90 degrees is selected.

Figure 9:
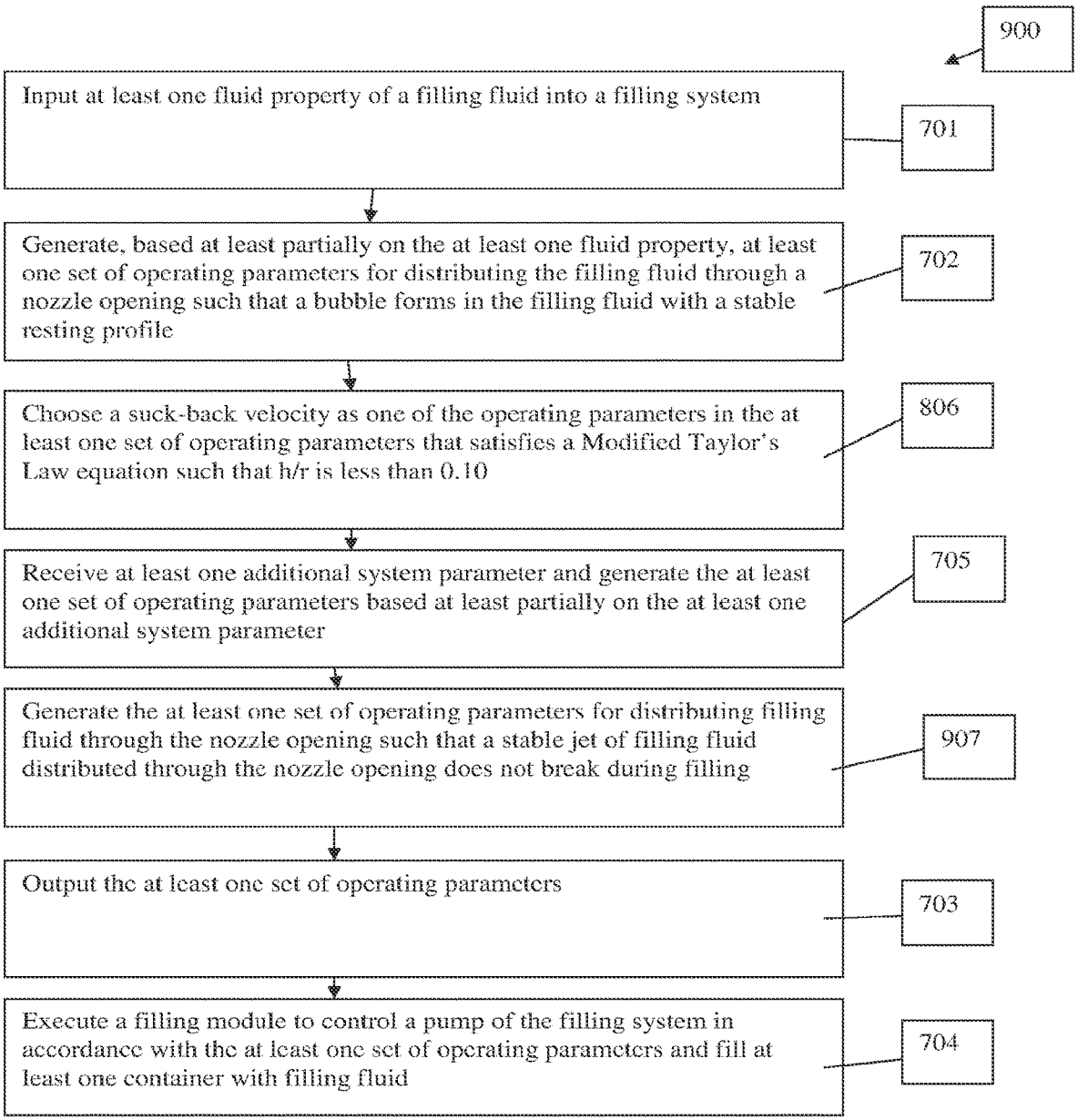
FIG. 9 is a flow chart illustrating a further sequence of steps for operating a filling system in an exemplary embodiment.

Referring now to FIG. 9, another sequence of steps for a method operating the filling system 100 in an exemplary embodiment is illustrated. The method 900 includes the steps 701, 702, 703, and in some embodiments, steps 704 and 705, of the method 700 and the step 806 of the method 800, as well as an additional step 907. Step 907 includes generating, based at least partially on the at least one fluid property, the at least one set of operating parameters for distributing the filling fluid through the nozzle opening 221 such that a stable jet of filling fluid distributed through the nozzle opening 221 does not break during filling. The stable jet of filling fluid reduces the risk of the filling fluid forming droplets between the nozzle opening 221 and material of the container being filled, or fluid already distributed to the container, to reduce the risk of filling fluid splashing. Reducing the risk of the filling fluid splashing during the filling procedure reduces the risk of the splashed filling fluid drying on the outside of the filling nozzle 120, as well as any associated stopper equipment.

In some embodiments, the at least one set of operating parameters is generated to produce an Ohnesorge number ($Oh_R$) that results in the stable jet of filling fluid being distributed from the nozzle opening 221. The Ohnesorge number may be determined from the equation $$Oh_R^2 = \frac{2\mu^2}{\rho\gamma R},$$

where μ is the dynamic viscosity of the filling fluid, ρ is the density of the filling fluid, γ is the surface tension of the filling fluid, and R is the radius r of the filling nozzle 120. Various Ohnesorge numbers and associated critical lengths are described by Driessen et al. in an article entitled "Stability of viscous long liquid filaments" published in "Physical Fluids" in 2013 (hereafter "Driessen et al"), which is incorporated in its entirety herein by reference. For a particular critical length (Γ) representing the distance the jet remains stable (in units of filling needle radius), the associated Ohnesorge number resulting in a stable jet of filling fluid can be generated, in some embodiments, based on previously determined stable and unstable experimental points. For convenience of description, the filling fluid being distributed from the filling nozzle 120 as a stable jet may be referred to as "Condition 3."

As can be appreciated, the filling module may generate the at least one set of operating parameters to satisfy Condition 1 and Condition 2, as discussed previously, as well as Condition 3 simultaneously. When the filling fluid is distributed from the filling system according to one or more sets of operating parameters satisfying Condition 1, Condition 2, and Condition 3 simultaneously, consistent filling of containers may be achieved with a reduced risk of the filling fluid drying and clogging or otherwise detrimentally affecting operation of the filling system 100. It should be appreciated that the set(s) of operating parameters may satisfy only one of consistent filling of containers and inhibition of drying of and clogging by the filling fluid that is gained by establishing one or more sets of operating parameters that account for the previously described fluid dynamic behaviors. Thus, the filling system 100 and the methods 700, 800, 900 described herein may be utilized to establish operating parameters constraints for operating the filling system 100 that account for the previously described fluid dynamic behaviors. Accounting for the previously described fluid dynamic behaviors can increase fill volume consistency, reduce downtime caused by clogging, and increase active ingredient distribution consistency.

In some exemplary embodiments, such as when the filling fluid comprises a biologic drug product that is susceptible to damage from shear stress, the at least one set of operating parameters can be generated to avoid damaging one or more components of the filling fluid. For example, the at least one set of operating parameters can be generated with a flow velocity of the filling fluid that limits the fluid shear stress on the filling fluid below a maximum tolerable shear value to limit damaging one or more components of the filling fluid. The maximum tolerable shear value may vary for different filling fluids. In some exemplary embodiments, the filling fluid comprises a biologic drug product including, but not limited to, at least one of a protein, an antibody, a sugar, one or more nucleic acids, one or more cells, and one or more tissues. The filling fluid may also comprise other substances accompanying the biologic drug product, including, but not limited to, at least one of a carrier fluid, one or more additional active ingredients, a surfactant, a stabilizer, an adjuvant, encapsulating particles, and a buffer solution.

To test the ability of the filling system 100 to accurately distribute fluid as previously described, various tests were performed to determine whether a bubble with a stable resting profile formed in various fluids. The fluids and the fluid density and surface tension of each fluid are shown in Table 1 below. The fluids were tested in a variety of pipettes having various radii, which are described in Table 2 below.

One exemplary filling fluid is an aluminum hydroxide suspension representative of a vaccine formulation/suspension formulation. This is provided in the tables below with two different fluid properties due to the addition of a surfactant to formulation B.

Another exemplary filling fluid comprises an antibody A with inactive ingredients including a surfactant, which has properties described in Table 1. For example, the antibody A may be a humanized antibody that specifically binds to human α4β7 integrin, and is also known as "vedolizumab."

Various methods may be used to produce the anti-α4β7 antibody vedolizumab, or antibodies having antigen-binding regions of vedolizumab. Vedolizumab is also known by its trade name ENTYVIO® (Takeda Pharmaceuticals, Inc.). Vedolizumab is a humanized antibody that comprises a human IgG1 framework and constant regions and antigen-binding CDRs from the murine antibody Act-1. The vedolizumab CDRs, variable regions and mutated Fc region (mutated to eliminate Fc effector functions) are described in U.S. Pat. No. 7,147,851, which is incorporated in in its entirety by reference herein. Formulations of vedolizumab are also described in U.S. Pat. No. 9,764,033 and U.S. Patent Application Publication No. 20140341885, which are also incorporated in their entirety by reference herein.

It should be appreciated that while the antibody A is one of only two biologic drug products listed in Table 1, other biologic drug products, such as other antibodies, therapeutic proteinaceous material, cell suspensions, liposomes, vaccines or nucleic acid materials, can fill containers according to the present disclosure. Other biologic drug products may have, for example, densities between 0.8 g/mL and 1.2 g/mL and surface tensions between 35 mN/m and 75 mN/m. For example, antibody B was formulated without surfactant and shows static fluid properties in a wider diameter filling nozzle (or pipette) than antibody A, which had surfactant. Similarly, the aluminum hydroxide (vaccine formulation) samples differed in the presence of surfactant in formulation B, resulting in a lower surface tension than formulation A, without surfactant, which was static in wider diameter nozzles than formulation B.

It should be appreciated that the previously described values are exemplary only, and containers, e.g., tubes, vials, cartridges, syringes, capsules, may be filled with many different types of biologic drug products according to the present disclosure. The systems and methods may be used in manufacturing the biologic pharmaceutical products, such as antibodies, enzymes, blood factors or vaccines by improving the accuracy and line throughput when filling the liquid biologic formulations into the containers.

TABLE 1

| | Density (g/mL) | surface tension (mN/m) |
|---|---|---|
| water | 0.99824 | 72.4 |
| saline | 1.0046 | 72.1 |
| dextrose | 1.0173 | 72.8 |
| high NaCl | 1.19576 | 82.5 |
| high sucrose | 1.18873 | 75.3 |
| water + PS20 | 0.99865 | 36.2 |
| saline + PS20 | 1.00512 | 36.3 |
| dextrose + PS20 | 1.01772 | 36.4 |
| high NaCl + PS20 | 1.19544 | 33.3 |
| 10 mg/ml aluminum hydroxide A | 1.01369 | 72.885 |
| high sucrose + PS20 | 1.18835 | 35.3 |
| PEG400 | 1.12562 | 45.3 |
| propylene glycol | 1.0362 | 36.2 |
| ethanol | 0.85346 | 25.7 |
| IPA | 0.78513 | 21.2 |
| silicone oil | 0.96828 | 20.3 |
| antibody A | 1.05874 | 38.7 |
| antibody B | 1.0251 | 60.298 |
| 10 mg/ml aluminum hydroxide B | 1.0131 | 40.3 |

TABLE 2

| Pipette | 50 | 25 | 10 | 5 | 2 | 1 |
|---|---|---|---|---|---|---|
| radius (m) | 0.0079089 | 0.0063501 | 0.00396 | 0.002986 | 0.002033 | 0.001462 |

From the fluid properties of the fluids described in Table 1 and the pipette dimensions described in Table 2, predicted Bond number values were generated, as shown in Table 3 below. The predicted Bond numbers below the previously described value of 0.842 are displayed in bold and italics within their cells.

TABLE 3

| | pipette | | | | | |
|---|---|---|---|---|---|---|
| liquid | 50 | 25 | 10 | 5 | 2 | 1 |
| Water | 8.4561976 | 5.4513529 | 2.119835 | 1.205396 | ***0.558866*** | ***0.28881*** |
| Saline | 8.5527316 | 5.5135844 | 2.144035 | 1.219157 | ***0.565245*** | ***0.292107*** |
| dextrose | 8.5801214 | 5.5312414 | 2.150901 | 1.223061 | ***0.567056*** | ***0.293042*** |
| high NaCl | 8.8897259 | 5.7308303 | 2.228514 | 1.267194 | ***0.587517*** | ***0.303616*** |
| high sucrose | 9.6841683 | 6.2429737 | 2.427668 | 1.380439 | ***0.640022*** | ***0.330749*** |
| 10 mg/ml aluminum hydroxide A | 9.6841683 | 6.2429737 | 2.427668 | 1.380439 | ***0.63795*** | ***0.330749*** |
| water + PS20 | 16.917917 | 10.906266 | 4.241054 | 2.41158 | 1.118096 | ***0.577808*** |
| saline + PS20 | 17.003361 | 10.961348 | 4.262474 | 2.42376 | 1.123743 | ***0.580726*** |
| dextrose + PS20 | 17.144448 | 11.052301 | 4.297842 | 2.443871 | 1.133067 | ***0.585543*** |
| high NaCl + PS20 | 22.006686 | 14.18678 | 5.516728 | 3.136963 | 1.45441 | ***0.751608*** |
| high sucrose + PS20 | 20.68364 | 13.333868 | 5.185061 | 2.948368 | 1.366971 | ***0.706421*** |
| PEG400 | 15.250263 | 9.8311997 | 3.823 | 2.173863 | 1.007882 | ***0.520852*** |
| propylene glycol | 17.584124 | 11.335741 | 4.408062 | 2.506545 | 1.162125 | ***0.600561*** |
| ethanol | 20.384238 | 13.140856 | 5.110006 | 2.90569 | 1.347183 | ***0.696195*** |
| IPA | 22.718436 | 14.645615 | 5.695153 | 3.23842 | 1.501449 | ***0.775917*** |
| silicone oil | 29.221473 | 18.837848 | 7.325361 | 4.165401 | 1.931232 | 0.9980019 |

TABLE 3-continued

| liquid | pipette 50 | 25 | 10 | 5 | 2 | 1 |
|---|---|---|---|---|---|---|
| antibody A | 16.776727 | 10.815246 | 4.20566 | 2.391454 | 1.108765 | ***0.572986*** |
| antibody B | 10.43165 | 6.7248435 | 2.61505 | 1.486989 | ***0.687191*** | ***0.356279*** |
| 10 mg/ml aluminum hydroxide B | 15.425496 | 9.9441652 | 3.866928 | 2.198841 | 1.016164 | ***0.526836*** |

Figure 5:
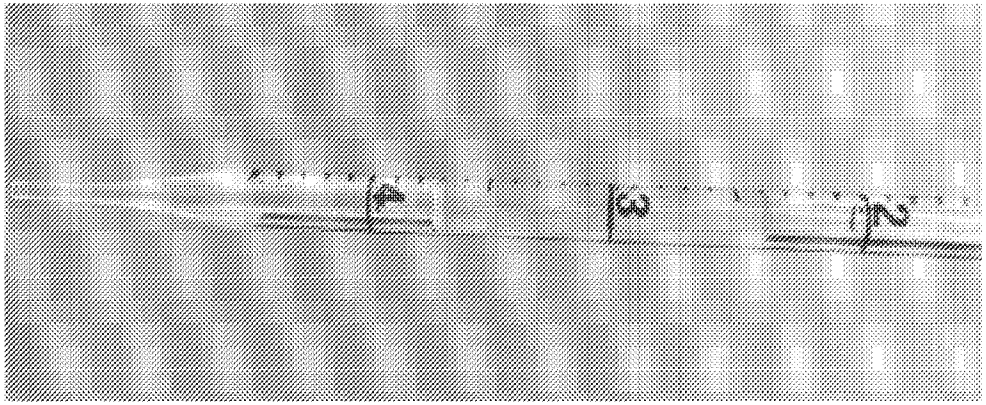
FIG. 5 is a side view of a pipette containing a formed bubble with a stable resting profile.
Figure 6:
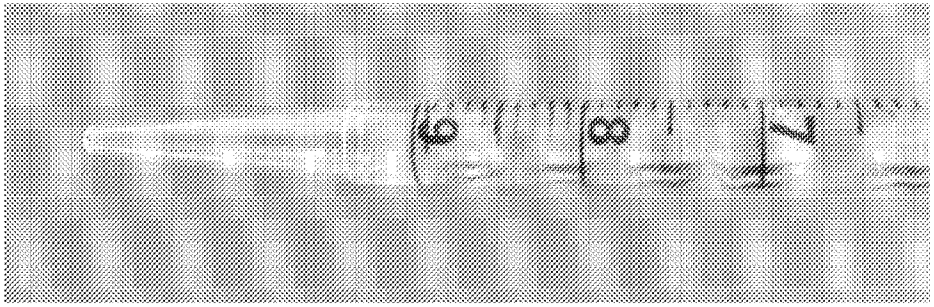
FIG. 6 is a side view of a pipette containing a formed bubble with an unstable resting profile.

After predicting the Bond numbers, an experiment was conducted to see if a bubble (or other fluid interface) with a stable resting profile, i.e., a static profile, would form in the fluids after distribution from the corresponding pipette. To determine whether a bubble with a stable resting profile would be formed, serological pipettes were attached to a pipette gun. The pipette gun aspirated the various fluids into the pipettes, which were then placed in a burette stand for a five-minute period to equilibrate. Following the five-minute equilibration period, a qualitative observation was made to determine whether the formed bubble was static, as shown in FIG. 5, or moving, as shown in FIG. 6. For Bond numbers greater than 0.842, it was predicted that a bubble with an unstable resting profile, i.e., moving, would form in the fluids after distribution from the corresponding pipette. The results of these tests are shown in Table 4 below.

TABLE 4

| liquid | pipette 50 | 25 | 10 | 5 | 2 | 1 |
|---|---|---|---|---|---|---|
| Water | moving | moving | moving | static* | static | static |
| Saline | moving | moving | moving | static* | static | static |
| dextrose | moving | moving | moving | static* | static | static |
| high NaCl | moving | moving | moving | static* | static | static |
| 10 mg/ml aluminum hydroxide A | moving | moving | moving | static* | static | static |
| high sucrose | moving | moving | moving | moving | moving | static |
| water + PS20 | moving | moving | moving | moving | moving | static |
| saline + PS20 | moving | moving | moving | moving | moving | static |
| dextrose + PS20 | moving | moving | moving | moving | moving | static |
| high NaCl + PS20 | moving | moving | moving | moving | moving | static |
| high sucrose + PS20 | moving | moving | moving | moving | moving | static |
| PEG400 | moving | moving | moving | moving | moving | static |
| propylene glycol | moving | moving | moving | moving | moving | static |
| ethanol | moving | moving | moving | moving | moving | static |
| IPA | moving | moving | moving | moving | moving | static |
| silicone oil | moving | moving | moving | moving | moving | moving |
| antibody A | moving | moving | moving | moving | moving | static |
| antibody B | moving | moving | moving | moving | static | static |
| 10 mg/ml aluminum hydroxide B | moving | moving | moving | moving | moving | static |

As can be seen, the fluids in pipettes with a Bond number below 0.842 all formed a bubble with a stable resting profile after distribution of the fluid from the pipette. Surprisingly, it was found that certain fluids (water, saline, dextrose, and high NaCl) formed a quasi-static bubble in the filling fluid after distribution from the pipette. The formed bubble was "quasi-static" in the sense that the bubble would not move at rest, but could begin moving upon a "shock" being delivered to the fluid, such as a force pulling the fluid away from the pipette opening, i.e., a reverse flow or "suck-back" force. It was noted that the quasi-static bubbles formed in fluids having a high contact angle relative to the pipette material, which may be relevant to filling nozzles comprising materials that do not satisfy other criteria for operating the filling system 100.

In one embodiment, another approach is used that highlights three parameters that impact fluid jet break-up (density, radius, and surface tension). This approach is similar to the Ohnesorge number discussed above, but does not have the viscous forces captured as it assumes the Reynolds (ratio of inertial forces to viscous forces) number is high enough that it can be neglected. The approach utilizes an equation:

$$t \cong \sqrt{\frac{\rho r^3}{\gamma}}$$

that comes from linearizing the governing equations assuming infinitesimal varicose perturbations on the interface. This can then be solved as a modified Bessel Equation, and the characteristic break-up time assumed to be the inversion of maximum growth rate (the fastest growing perturbation occurs when wavelength=9.02*Radius), an approach consistent with well-established fluid dynamics. In the equation, the break-up time (t) is approximated with r as a nozzle radius, ρ as a density defined by the filling fluid, and γ as a fluid surface tension. In some embodiments, this equation may be used as an alternate control option since the perturbations in filling line under nominally laminar flow can become complex due to the effects from other equipment in the line.

Accordingly, in one embodiment, this characteristic breakup time equation may be used instead of using the Ohnesorge number, using the assumption of high Reynolds number to determine minimum acceptable filling needle radius for a stable liquid jet. It should be appreciated that this approach will work if one can set a filling time on the sterile line constrained by a maximum liquid velocity and fixed distance from the filling needle to the bottom of the container. The maximum liquid velocity may be set by the maximum shear the fluid can withstand before a product quality attribute of the fluid is impacted due to shear from the mechanisms of pump operation. In all cases the maximum value is still set by Bond number <0.842.

Figure 10A:
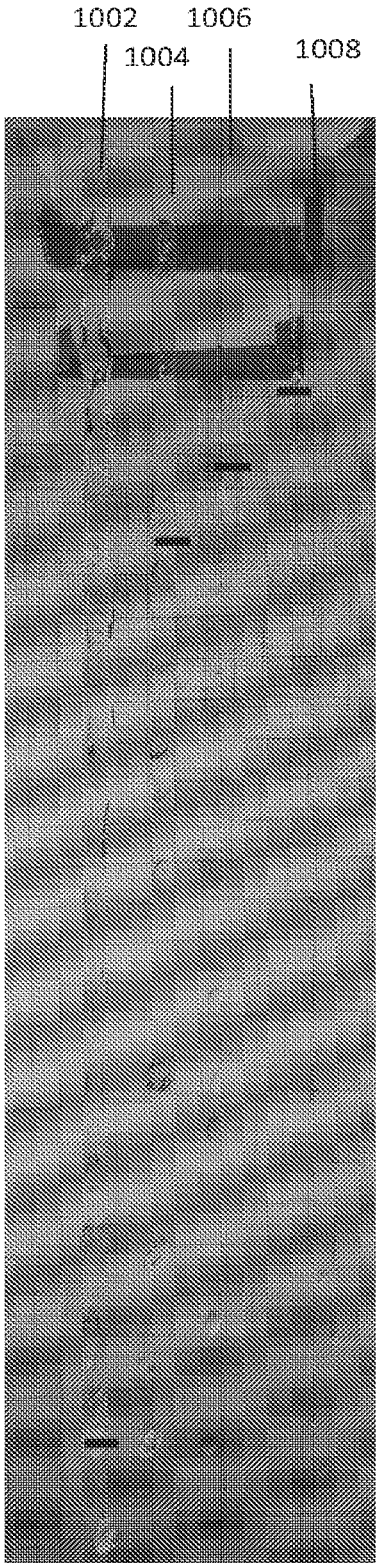
FIG. 10A depicts views of columns of fluid flowing from openings of filling nozzles of different diameters to demonstrate flow profiles resulting from different filling nozzle diameters.
Figure 10B:
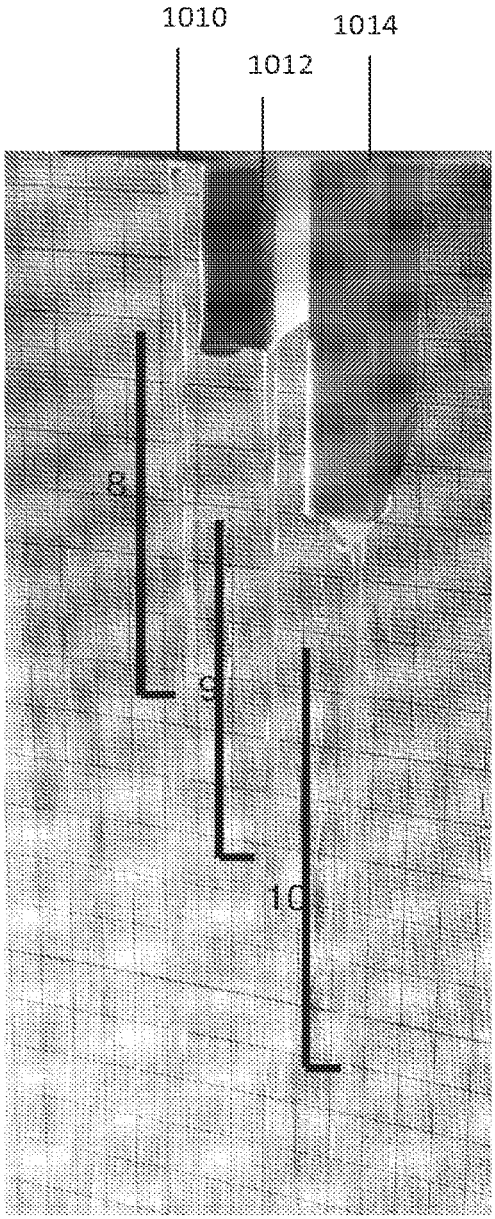
FIG. 10B depicts views of columns of fluid flowing from openings of filling nozzles to demonstrate flow profiles resulting from different filling velocities.

FIGS. 10A and 10B depict well-known effects of Rayleigh-Plateau instability and illustrate two engineering options to achieve a longer stable profile, namely by designing a system using a bigger filling nozzle diameter and/or a faster fluid velocity.

FIG. 10A depicts views of columns of fluid flowing from openings of filling nozzles of different diameters to demonstrate flow profiles resulting from different filling nozzle diameters. A filling nozzle opening of 10 millimeters in diameter is illustrated at 1002. A filling nozzle opening of 5 millimeters in diameter is illustrated at 1004. A filling nozzle opening of 3 millimeters in diameter is illustrated at 1006. A filling nozzle opening of 1.6 millimeters in diameter is illustrated at 1008. As illustrated, larger diameter holes produce more stable columns.

FIG. 10B depicts views of three columns of fluid 1010, 1012 and 1014 flowing from openings of filling nozzles to demonstrate flow profiles resulting from different filling velocities. All columns are subjected to gravitational acceleration which shrinks their column diameters (due to conservation of mass) to the point that they are then susceptible to perturbation. Faster flowing columns travel further over the same duration. Velocity is affected by the volumetric flow rate and filling needle exit diameter. For a peristaltic pump the volumetric flow is driven by pump RPM and pump tubing diameter. In FIG. 10B the column 1010 on the left has the smallest hydrostatic head and thus the slowest exit velocity while the column 1014 on the right has the highest exit velocity and thus travels farther.

Figure 11:
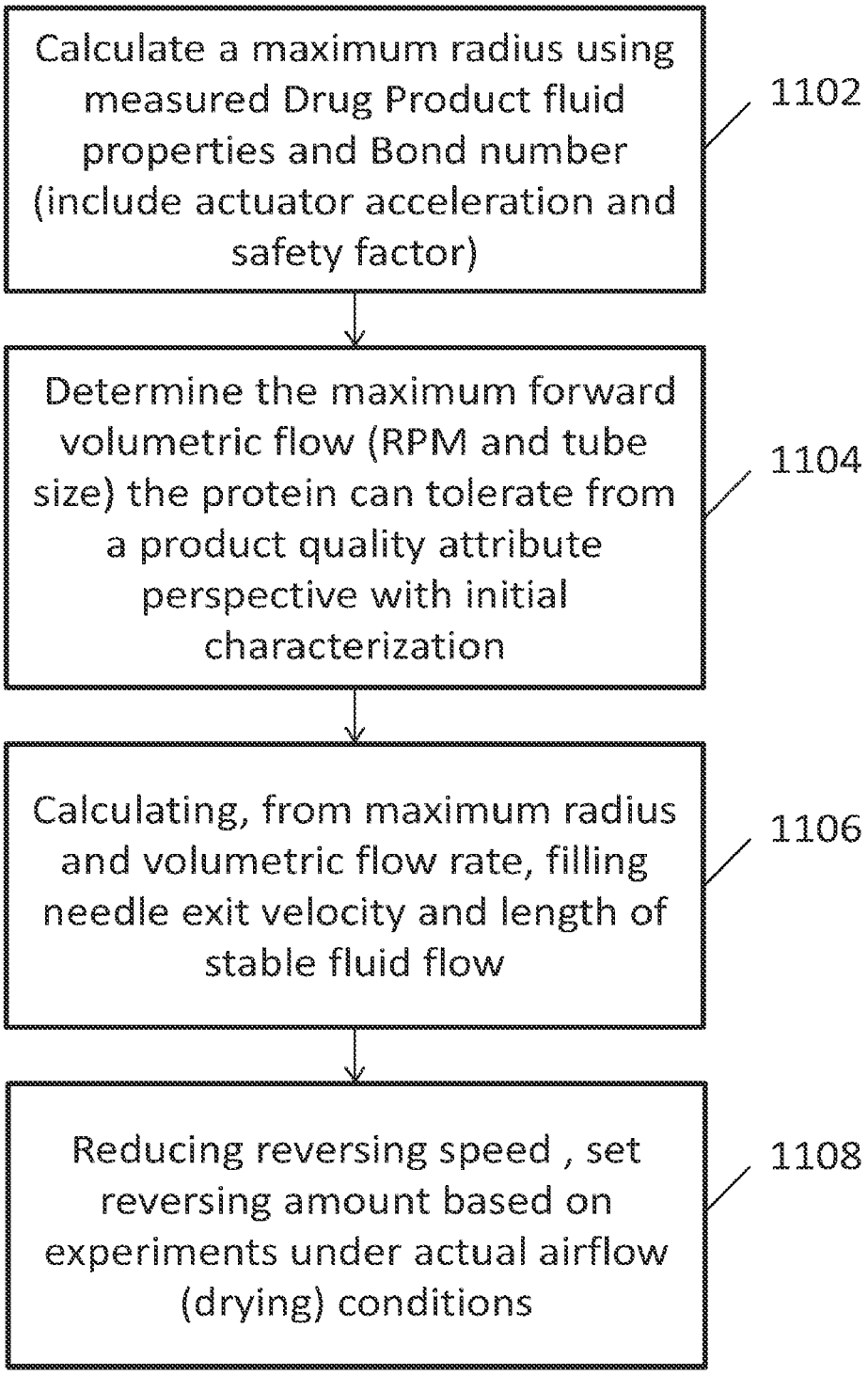
FIG. 11 is a flow chart illustrating an exemplary sequence of steps for designing a filling system in an exemplary embodiment.

FIG. 11 is a flow chart illustrating an exemplary sequence of steps for a method of designing a filling system in an exemplary embodiment. At step 1102, the method involves calculating a maximum radius using measured Drug Product fluid properties and Bond number (include actuator acceleration and safety factor). At step 1104, the method involves determining what the maximum forward volumetric flow (RPM and tube size) the protein can tolerate from a product quality attribute perspective with initial characterization of these attributes prior to pumping. At step 1106, the method involves calculating, from maximum radius and volumetric flow rate, filling needle exit velocity and length of stable fluid flow. At step 1108, the method involves reducing reversing speed as much as reasonable given the financial constraints of operating a filling line and the limitation to maintain a sterile environment as determined by media fill for pharmaceutical products, and setting a reversing distance of approximately three filling needle diameters such as, but not limited to techniques determined by Hanslip et al., (see e.g., J. Pharm Sci. 108:1130-1138, (2019).

Figure 12:
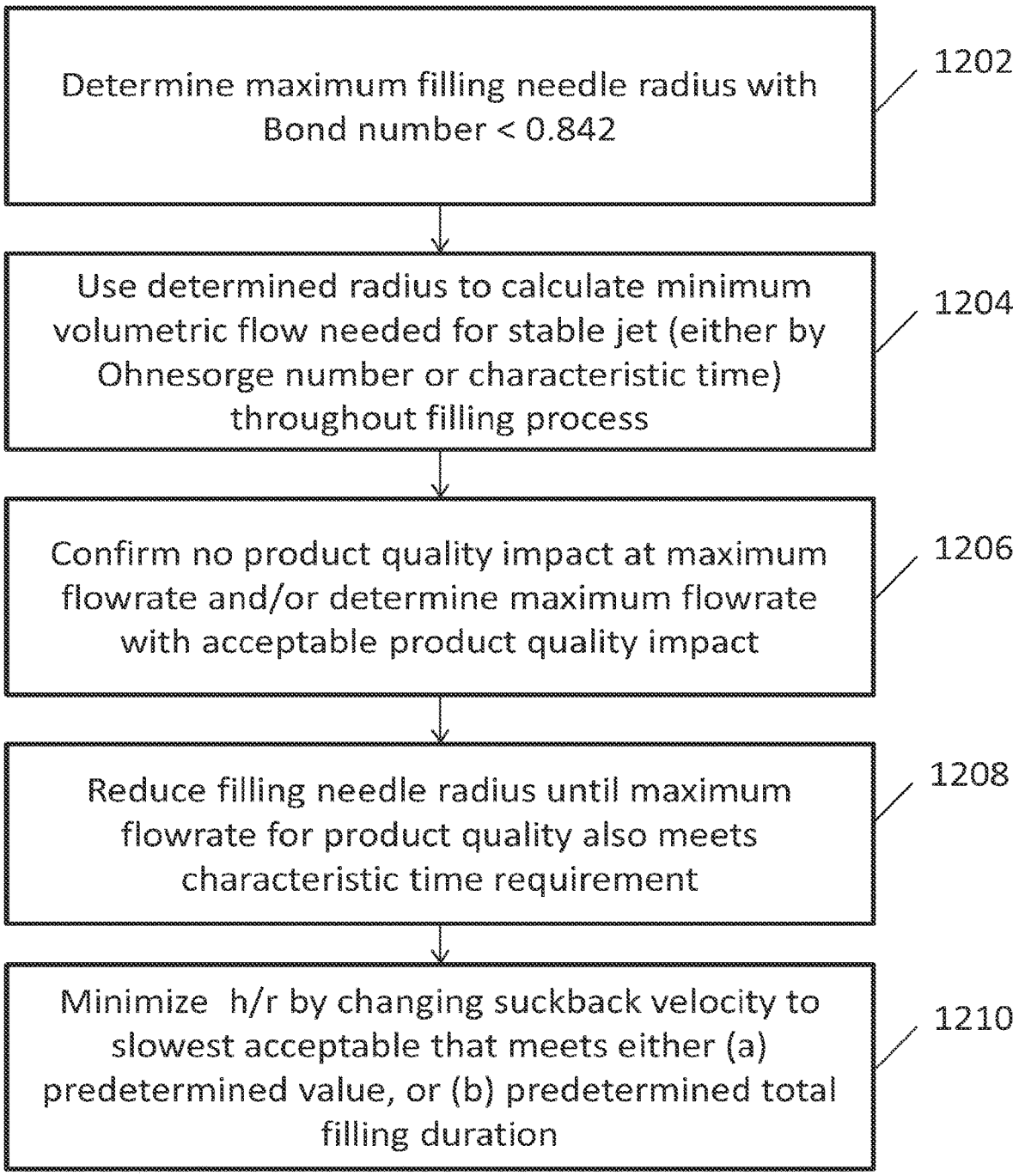
FIG. 12 is a flow chart illustrating another exemplary sequence of steps for designing a filling system in an exemplary embodiment.

FIG. 12 is a flow chart illustrating another sequence of steps for a method for designing a filling system in an exemplary embodiment. At step 1202, the method involves determining a maximum filling needle radius with Bond number <0.842. At step 1204, the method involves using the determined radius to calculate minimum volumetric flow needed for a stable jet (either by Ohnesorge number or by characteristic time requirement) throughout a filling process. The characteristic time is defined a function of an initial fluid jet radius that determines the time required for the jet to break up assuming maximum growth of perturbations. The characteristic time must exceed the time required for the jet to traverse the distance between the filling needle and the bottom of the container as calculated by exit velocity and any acceleration gain or loss due to gravity (or any similar body force). At step 1206, the method involves confirming that there is no product quality impact at a maximum flowrate and/or determining a maximum flowrate with acceptable product quality impact. At step 1208, the method involves reducing the filling needle radius until the maximum flowrate for product quality also meets the characteristic time requirement. At step 1210, the method involves minimizing h/r by changing suckback velocity to the slowest acceptable velocity that meets either (a) predetermined value, (e.g. 10%), or (b) predetermined total filling duration (e.g. 5 seconds per fill), wherein h/r is a formed film thickness divided by a radius of the nozzle opening.

In one exemplary embodiment for distributing filling fluid according to the present disclosure, the filling fluid comprising antibody A with fluid properties described in Table 1 was distributed into 1 mL Long (1 mLL) ISO syringes with a target fill volume of 741 μL. The antibody A also had a viscosity of 15.75 cP at 20° C. It was found that the standard deviation of fill volumes was below a target 2.000% as a percentage of fill volume, when distributed according to sets of operating parameters that satisfied the previously described Condition 1, Condition 2, and Condition 3. The standard deviation of fill volumes was reliably found to be within 1%. Further, it was found that the distribution of antibody A from the test nozzle could be interrupted for 20 minutes without clogging of the nozzle. Thus, it was concluded that antibody A, and other filling fluids that comprise one or more biologic drug products, can fill containers according to the present disclosure with high precision and accuracy in a manner that resists drying of the fluid after filling.

In one embodiment, a filling system may be designed and operated as described herein to include a stable resting profile, a stable retracting profile and a stable flowing profile. The pump speed may be controlled so that it is as slow as possible in reversing (based on pre-determined criteria from test results for different fluids) and as fast as possible during the filling operation while satisfying these profile constraints. In some embodiments, filling systems designed to include a smaller filling needle radius and a slower suck-back speed substantially increase accuracy (limiting fluid loss) and provide the ability to interrupt the filling line for longer periods of time up to and exceeding 20 minutes without clogs occurring.

Figure 13A:
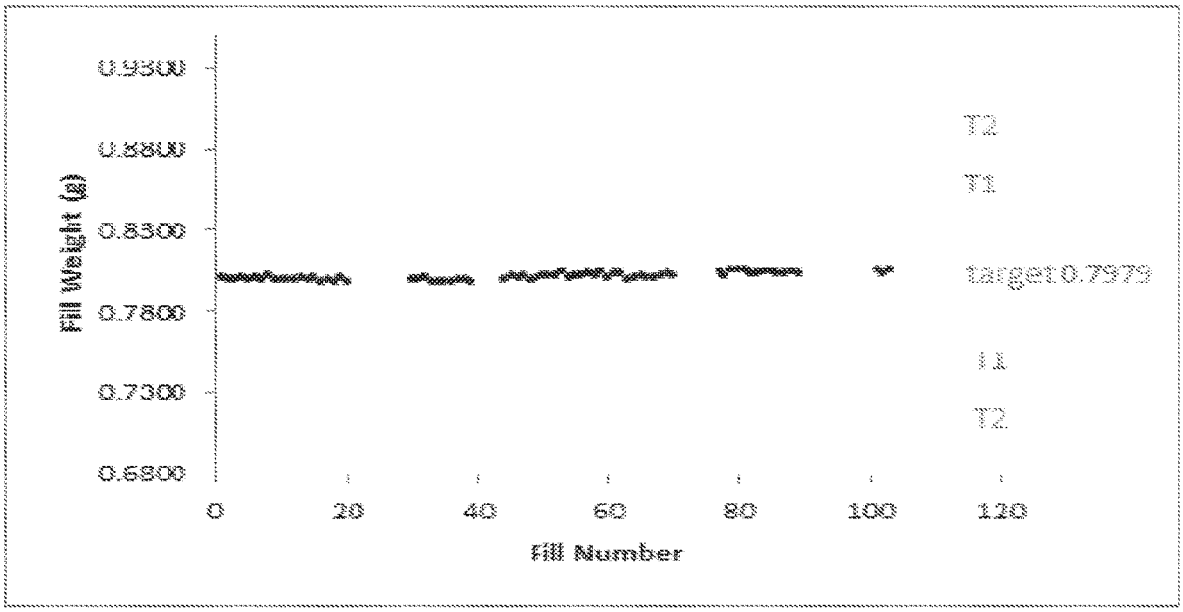
FIGS. 13A and 13B are charts depicting testing of two variations when filling containers in exemplary embodiments.
Figure 13B:
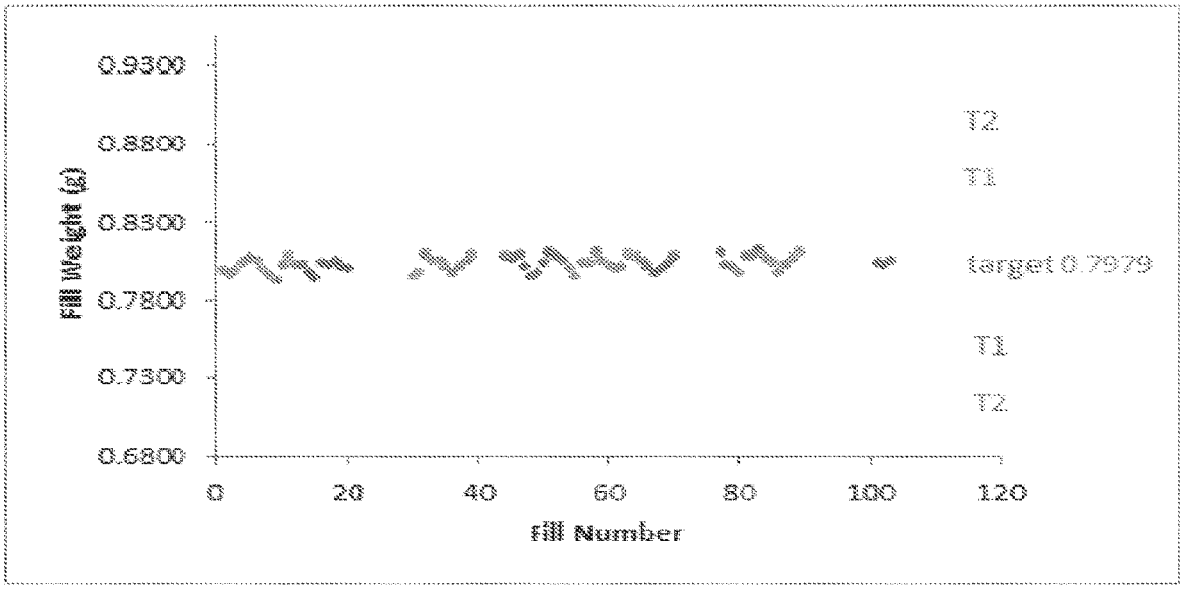

Exemplary filling results may be seen in results of a development pump/fill study attached hereto as Exhibit A. It should be noted that Variants #1 and #2 demonstrate the lack of needle clogging when using the filling process constrained by these equations and that Variant #1 has a smaller filling needle and thus is slightly more consistent. In the study, the pump/fill settings for a Bosch™ pump were as follows:

Variation #1
1.6 mm ID Filling Needle (steel)
1.2 mm ID pump tube diameter
365 RPM
0.5 acceleration filling
0.5 deceleration filling
0.4 acceleration reversing
15 Reverse/back suction
Variation #2
2.5 mm ID Filling Needle (steel)
1.6 mm ID pump tube diameter
450 RPM
0.5 acceleration filling
0.5 deceleration filling
0.4 acceleration reversing
15 Reverse/back suction FIGS. 13A and 13B each represent data collected for separate variations. The x-axis represents chronological filling steps using the same filling needle, and the y-axis represents the measured fill weight (in grams) against a target weight. The variation from one filling step to the next closely matches the predicted film thickness for each profile when using Taylor's law, as described above. The extent of oscillation is determined by a volume required to form a liquid bridge in the filling needle.

Figure 14:
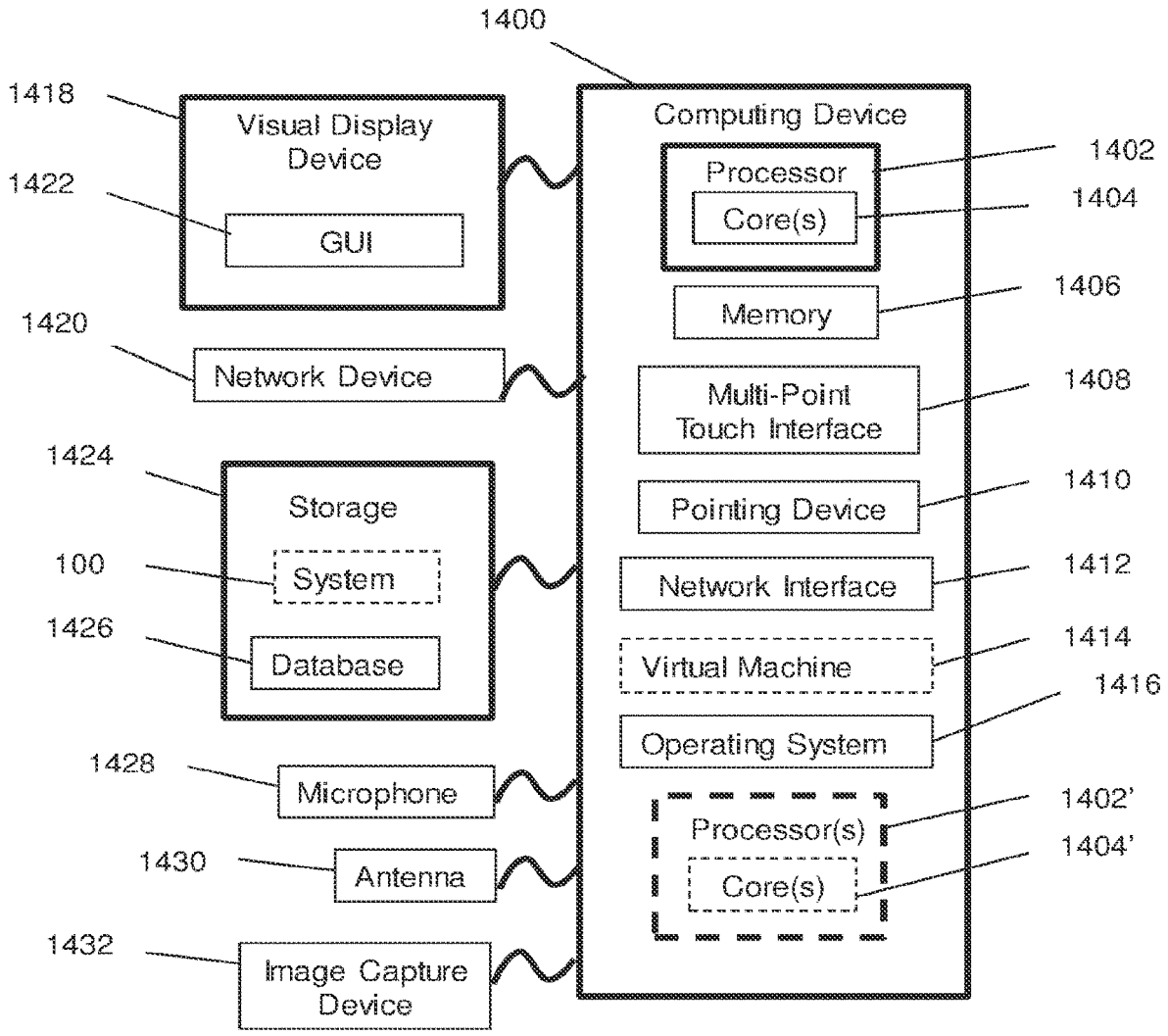
FIG. 14 depicts an exemplary computing device suitable for use in embodiments.

Embodiments described herein have described the use of a computing device equipped with a processor executing a filling module. FIG. 14 depicts an exemplary computing device suitable for use by embodiments of the present invention. FIG. 14 is a block diagram of an exemplary computing device 1400 that may be used to implement exemplary embodiments of the filling system 100 described herein. The computing device 1400 includes one or more non-transitory computer-readable media for storing one or more computer-executable instructions or software for implementing exemplary embodiments. The non-transitory computer-readable media may include, but are not limited to, one or more types of hardware memory, non-transitory tangible media (for example, one or more magnetic storage disks, one or more optical disks, one or more flash drives), and the like. For example, memory 1406 included in the computing device 1400 may store computer-readable and computer-executable instructions or software for the filling module used in implementing exemplary embodiments of the filling system 100. The computing device 1400 also includes configurable and/or programmable processor 1402 and associated core 1404, and optionally, one or more additional configurable and/or programmable processor(s) 1402' and associated core(s) 1404' (for example, in the case of computer systems having multiple processors/cores), for executing computer-readable and computer-executable instructions or software stored in the memory 1406 and other programs for controlling system hardware. Processor 1402 and processor(s) 1402' may each be a single core processor or multiple core (1404 and 1404') processor.

Virtualization may be employed in the computing device 1400 so that infrastructure and resources in the computing device may be shared dynamically. A virtual machine 1414 may be provided to handle a process running on multiple processors so that the process appears to be using only one computing resource rather than multiple computing resources. Multiple virtual machines may also be used with one processor.

Memory 1406 may include a computer system memory or random access memory, such as DRAM, SRAM, EDO RAM, and the like. Memory 1406 may include other types of memory as well, or combinations thereof.

A user may interact with the computing device 1400 through a visual display device 1418, such as a computer monitor, which may display one or more graphical user interfaces 1422 that may be provided in accordance with exemplary embodiments. The computing device 1400 may include other I/O devices for receiving input from a user, for example, a keyboard or any suitable multi-point touch interface 1408, a pointing device 1410 (e.g., a mouse), a microphone 1428, and/or an image capturing device 1432 (e.g., a camera or scanner). The multi-point touch interface 1408 (e.g., keyboard, pin pad, scanner, touchscreen, etc.) and the pointing device 1410 (e.g., mouse, stylus pen, etc.) may be coupled to the visual display device 1418. The computing device 1400 may include other suitable conventional I/O peripherals.

The computing device 1400 may also include one or more storage devices 1424, such as a hard-drive, CD-ROM, or other computer readable media, for storing data and computer-readable instructions and/or software that implement exemplary embodiments of the filling system 100 described herein. Exemplary storage device 1424 may also store one or more databases for storing any suitable information required to implement exemplary embodiments. For example, exemplary storage device 1424 can store one or more databases 1426 for storing information regarding fluid properties, system properties and/or any other information to be used by embodiments of the filling system 100. The databases may be updated manually or automatically at any suitable time to add, delete, and/or update one or more items in the databases.

The computing device 1400 can include a network interface 1412 configured to interface via one or more network devices 1420 with one or more networks, for example, Local Area Network (LAN), Wide Area Network (WAN) or the Internet through a variety of connections including, but not limited to, standard telephone lines. LAN or WAN links (for example, 802.11. T1, T3, 56 kb, X.25), broadband connections (for example, ISDN, Frame Relay, ATM), wireless connections, controller area network (CAN), or some combination of any or all of the above. In exemplary embodiments, the computing device 1400 can include one or more antennas 1430 to facilitate wireless communication (e.g., via the network interface) between the computing device 1400 and a network. The network interface 1412 may include a built-in network adapter, network interface card, PCMCIA network card, card bus network adapter, wireless network adapter, USB network adapter, modem or any other device suitable for interfacing the computing device 1400 to any type of network capable of communication and performing the operations described herein. Moreover, the computing device 1400 may be any computer system, such as a workstation, desktop computer, server, laptop, handheld computer, tablet computer, mobile computing or communication device such as a smartphone, internal corporate devices, or other form of computing or telecommunications device that is capable of communication and that has sufficient processor power and memory capacity to perform the operations described herein.

The computing device 1400 may run operating system 1416, such as versions of the Microsoft® Windows®, operating system, different releases of the Unix and Linux operating systems, versions of the MacOS® for Macintosh computers, embedded operating systems, real-time operating systems, open source operating systems, proprietary operating systems, or other operating systems capable of running on the computing device and performing the operations described herein. In exemplary embodiments, the operating system 1416 may be run in native mode or emulated mode. In an exemplary embodiment, the operating system 1416 may be run on one or more cloud machine instances.

In describing exemplary embodiments, specific terminology is used for the sake of clarity. For purposes of description, each specific term is intended to at least include all technical and functional equivalents that operate in a similar manner to accomplish a similar purpose. Additionally, in some instances where a particular exemplary embodiment includes a plurality of system elements or method steps, those elements or steps may be replaced with a single element or step. Likewise, a single element or step may be replaced with a plurality of elements or steps that serve the same purpose. Further, where parameters for various properties are specified herein for exemplary embodiments, those parameters may be adjusted up or down by 1/20th, $1/10^{th}$, $1/5^{th}$, 1/3rd, 1/2nd, and the like, or by rounded-off approximations thereof, unless otherwise specified. Moreover, while exemplary embodiments have been shown and described with references to particular embodiments thereof, those of ordinary skill in the art will understand that various substitutions and alterations in form and details may be made therein without departing from the scope of the invention. Further still, other aspects, functions and advantages are also within the scope of the invention.

| Fill Target (g) | | | | | |
|---|---|---|---|---|---|
| 0.797884 | | | active | | |
| Standard Deviation of Fill | | | | | |
| | Variation 1 | Variation 2 | Variation 3 | Variation 4 | Variation 5 |
| Weight Check | 0.001297 | 0.005661 | 0.00712 | 0.005339 | 0.00625 |

Calibration

| | Surrogate solution Density: 1.0729 g/mL | | Active solution Density: 1.0568 g/mL | | | | |
|---|---|---|---|---|---|---|---|
| No.: | Variation A [g] | Variation B [g] | Variation 1 [g] | Variation 2 [g] | Variation 3 [g] | Variation 4 [g] | Variation 5 [g] |
| 1 | 0.2527 | 0.2447 | 0.9813 | 0.7652 | 0.7574 | 0.7661 | 0.7670 |
| 2 | 0.8019 | 0.8109 | 0.7969 | 0.8039 | 0.8089 | 0.8093 | 0.8146 |
| 3 | 0.8225 | 0.8156 | 0.7963 | 0.8010 | 0.8093 | 0.8039 | 0.8089 |
| 4 | 0.8118 | 0.8167 | 0.7964 | 0.8020 | 0.7981 | 0.8065 | N/A |
| 5 | 0.8078 | 0.8136 | 0.7958 | 0.8110 | 0.8026 | 0.8014 | N/A |
| 6 | 0.8087 | 0.8115 | 0.7949 | 0.8097 | 0.7969 | 0.7977 | N/A |
| 7 | 0.8177 | 0.8166 | 0.7956 | 0.8087 | 0.7952 | 0.8016 | N/A |
| 8 | 0.8086 | 0.815 | 0.7995 | 0.8075 | 0.8019 | 0.8036 | N/A |
| 9 | 0.8082 | 0.8136 | 0.7941 | N/A | 0.8078 | 0.8093 | N/A |
| 10 | 0.8168 | 0.8145 | 0.7991 | N/A | 0.8012 | 0.8036 | N/A |
| 11 | 0.8144 | 0.8149 | N/A | N/A | 0.8036 | N/A | N/A |
| 12 | N/A | N/A | N/A | N/A | 0.8009 | N/A | N/A |
| 13 | N/A | N/A | N/A | N/A | 0.7954 | N/A | N/A |
| 14 | N/A | N/A | N/A | N/A | 0.8097 | N/A | N/A |
| Max. | 0.8225 | 0.8167 | 0.9813 | 0.811 | 0.8097 | 0.8093 | 0.8146 |
| Min. | 0.2527 | 0.2447 | 0.7941 | 0.7652 | 0.7574 | 0.7661 | 0.767 |
| Mean. | 0.7610 | 0.7625 | 0.8150 | 0.8011 | 0.7992 | 0.8003 | 0.7968 |
| Stdabw. | 0.1687 | 0.1717 | 0.0585 | 0.0150 | 0.0130 | 0.0125 | 0.0260 |

Fill weigh check

| | Surrogate solution- Density 1.0729 g/mL | | Active solution Density: 1.0568 g/mL | | | | | | |
|---|---|---|---|---|---|---|---|---|---|
| No.: | Variation A [g] | Variation B [g] | Variation 1 [g] | Variation 2 [g] | Variation 3 [g] | Variation 4 [g] | Variation 5 [g] | | |
| 1 | 0.7988 | 0.8141 | 0.8010 | 0.8027 | 0.8063 | 0.7988 | 0.8055 | | |
| 2 | 0.7944 | 0.8093 | 0.7990 | 0.8058 | 0.8064 | 0.7968 | 0.8185 | 100% | 0.742056 |
| 3 | 0.8231 | 0.8183 | 0.7997 | 0.8025 | 0.7933 | 0.7988 | 0.8194 | 100% | 0.742718 |
| 4 | 0.7970 | 0.8142 | 0.8002 | 0.8121 | 0.7964 | 0.8047 | 0.8141 | 100% | 0.743192 |
| 5 | 0.8160 | 0.8136 | 0.7989 | 0.8103 | 0.8028 | 0.8071 | 0.8038 | 100% | 0.741961 |
| 6 | 0.7964 | 0.8104 | 0.8006 | 0.8093 | 0.8046 | 0.8057 | 0.8096 | 100% | 0.74357 |
| 7 | 0.7994 | 0.8121 | 0.8000 | 0.7997 | 0.7976 | 0.3013 | 0.8166 | 100% | 0.743002 |
| 8 | 0.7913 | 0.8131 | 0.8020 | 0.8076 | 0.8056 | 0.7969 | 0..8196 | 101% | 0.744895 |
| 9 | 0.8186 | 0.8430 | 0.7990 | 0.8086 | 0.7939 | 0.7933 | 0.8146 | 100% | 0.742056 |
| 10 | 0.7911 | 0.8150 | 0.7995 | 0.7986 | 0.8110 | 0.8028 | 0.8079 | 100% | 0.742529 |
| 11 | 0.8101 | 0.8071 | 0.7994 | 0.8141 | 0.8073 | 0.8088 | 0.8159 | 100% | 0.742435 |
| 12 | 0.8032 | 0.8161 | 0.7992 | 0.8.100 | 0.8057 | 0.8051 | 0.8065 | 100% | 0.742245 |
| 13 | 0.7941 | 0.8092 | 0.8002 | 0.8090 | 0.7973 | 0.8033 | 0.8207 | 100% | 0.743102 |
| 14 | 0.8116 | 0.8141 | 0.7996 | 0.8069 | 0.8042 | 0.7990 | 0.8162 | 100% | 0.742624 |
| 15 | 0.8018 | 0.8169 | 0.8011 | 0.8059 | 0.7965 | 0.7942 | 0.8139 | 100% | 0.744043 |
| 16 | 0.7948 | 0.8077 | 0.7983 | 0.8035 | 0.8090 | 0.8042 | 0.8095 | 100% | 0.741204 |
| 17 | 0.7908 | 0.8175 | 0.7996 | 0.7995 | 0.8061 | 0.8030 | 0.8139 | 100% | 0.742624 |
| 18 | 0.8094 | 0.8116 | 0.7978 | 0.8132 | 0.8049 | 0.8062 | 0.8096 | 100% | 0.740921 |
| 19 | 0.8033 | 0.8076 | 0.8006 | 0.8095 | 0.7977 | 0.8024 | 0.8170 | 100% | 0.74357 |
| 20 | 0.7912 | 0.8158 | 0.7987 | 0.8086 | 0.7935 | 0.8002 | 0.8150 | 100% | 0.741772 |
| 21 | 0.8104 | 0.8120 | N/A | N/A | N/A | N/A | N/A | | |
| 22 | 0.8016 | 0.8442 | N/A | N/A | N/A | N/A | N/A | | |
| 23 | 0.7925 | 0.8087 | N/A | N/A | N/A | N/A | N/A | | |
| 24 | 0.8106 | 0.8179 | N/A | N/A | N/A | N/A | N/A | | |
| 25 | 0.7973 | 0.8151 | N/A | N/A | N/A | N/A | N/A | | |
| 26 | 0.7953 | 0.8066 | N/A | N/A | N/A | N/A | N/A | | |
| 27 | 0.7923 | 0.8155 | N/A | N/A | N/A | N/A | N/A | | |
| 28 | 0.8083 | 0.8158 | N/A | N/A | N/A | N/A | N/A | | |
| 29 | 0.8029 | 0.8131 | N/A | N/A | N/A | N/A | N/A | | |
| 30 | 0.7939 | 0.8124 | N/A | N/A | N/A | N/A | N/A | | |
| 31 | 0.8076 | 0.8116 | N/A | N/A | N/A | N/A | N/A | | |
| 32 | 0.7980 | 0.8085 | N/A | N/A | N/A | N/A | N/A | | |
| 33 | 0.7862 | 0.8148 | N/A | N/A | N/A | N/A | N/A | | |
| 34 | 0.7924 | 0.8123 | N/A | N/A | N/A | N/A | N/A | | |
| 35 | 0.8179 | 0.8100 | N/A | N/A | N/A | N/A | N/A | | |

-continued

| | | | | | | | | |
|---|---|---|---|---|---|---|---|---|
| 36 | 0.7960 | 0.8456 | N/A | N/A | N/A | N/A | N/A | |
| 37 | 0.7891 | 0.8116 | N/A | N/A | N/A | N/A | N/A | |
| 38 | 0.8084 | 0.8135 | N/A | N/A | N/A | N/A | N/A | |
| 39 | 0.8025 | 0.8084 | N/A | N/A | N/A | N/A | N/A | |
| 40 | 0.7925 | 0.8103 | N/A | N/A | N/A | N/A | N/A | |
| 41 | 0.8115 | 0.8187 | N/A | N/A | N/A | N/A | N/A | |
| 22 | 0.7935 | 0.8124 | N/A | N/A | N/A | N/A | N/A | |
| 43 | 0.7874 | 0.8074 | N/A | N/A | N/A | N/A | N/A | |
| 44 | 0.7907 | 0.8170 | N/A | N/A | N/A | N/A | N/A | |
| 45 | 0.8181 | 0.8134 | N/A | N/A | N/A | N/A | N/A | |
| 46 | 0.7924 | 0.8092 | N/A | N/A | N/A | N/A | N/A | |
| 47 | 0.7929 | 0.8123 | N/A | N/A | N/A | N/A | N/A | |
| 48 | 0.8121 | 0.8127 | N/A | N/A | N/A | N/A | N/A | |
| 49 | 0.7986 | 0.8408 | N/A | N/A | N/A | N/A | N/A | |
| 50 | 0.7913 | 0.8023 | N/A | N/A | N/A | N/A | N/A | |
| Max. | 0.8231 | 0.8456 | 0.8020 | 0.8141 | 0.8110 | 0.8088 | 0.8207 | 101% |
| Min. | 0.7891 | 0.8023 | 0.7978 | 0.7986 | 0.7925 | 0.7933 | 0.8038 | 100% |
| Mean. | 0.8008 | 0.8148 | 0.7997 | 0.8069 | 0.8020 | 0.8015 | 0.8134 | 100% |
| Stdabw. | 0.0091 | 0.0092 | 0.0010 | 0.0045 | 0.0057 | 0.0043 | 0.6050 | 0% |

Interruption study

| | Surrogate solution Density: 1.0729 g/mL | | Active solution Density: 1.0568 g/mL | | | | | | |
|---|---|---|---|---|---|---|---|---|---|
| No.: | Variation A [g] | Variation B [g] | Variation 1 [g] | Variation 2 [g] | Varsation 3 [g] | Variation 4 [g] | Variation 5 [g] | | |
| 30 | N/A | N/A | 0.7997 | 0.8087 | 0.8092 | 0.7953 | N/A | 100% | 0.742718 |
| 31 | N/A | N/A | 0.7989 | 0.8005 | 0.8053 | 0.7979 | N/A | 100% | 0.741961 |
| 32 | N/A | N/A | 0.8011 | 0.8099 | 0.8090 | 0.8094 | N/A | 100% | 0.744043 |
| 33 | N/A | N/A | 0.7985 | 0.7983 | 0.7974 | 0.8065 | N/A | 100% | 0.741583 |
| 34 | N/A | N/A | 0.7978 | 0.8138 | 0.8076 | 0.8056 | N/A | 100% | 0.740921 |
| 35 | N/A | N/A | 0.7977 | 0.8069 | 0.7996 | 0.8017 | N/A | 100% | 0.740826 |
| 36 | N/A | N/A | 0.7977 | 0.8148 | 0.8151 | 0.7982 | N/A | 100% | 0.740826 |
| 37 | N/A | N/A | 0.7998 | 0.8080 | 0.8114 | 0.8018 | N/A | 100% | 0.742813 |
| 38 | N/A | N/A | 0.7991 | 0.8009 | 0.8075 | 0.8053 | N/A | 100% | 0.742151 |
| 39 | N/A | N/A | 0.7975 | 0.8073 | 0.8026 | 0.8093 | N/A | 100% | 0.740637 |
| 40 | N/A | N/A | 0.7995 | 0.7992 | 0.7925 | 0.8078 | N/A | 100% | 0.742529 |
| 41 | N/A | N/A | 0.8059 | 0.8134 | 0.8139 | 0.8044 | N/A | 101% | 0.748585 |
| 42 | N/A | N/A | 0.7910 | 0.8119 | 0.8107 | 0.8001 | N/A | 99% | 0.735338 |
| 43 | N/A | N/A | 0.8080 | 0.8119 | 0.8002 | 0.7963 | N/A | 101% | 0.75114 |
| 44 | N/A | N/A | 0.7995 | 0.8085 | 0.8061 | 0.8079 | N/A | 100% | 0.742529 |
| 45 | N/A | N/A | 0.8014 | 0.8008 | 0.8054 | 0.8072 | N/A | 100% | 0.744327 |
| 46 | N/A | N/A | 0.8013 | 0.8099 | 0.7965 | 0.8095 | N/A | 100% | 0.744232 |
| 47 | N/A | N/A | 0.8018 | 0.8030 | 0.8098 | 0.8018 | N/A | 100% | 0.744706 |
| 48 | N/A | N/A | 0.7995 | 0.8017 | 0.8078 | 0.7952 | N/A | 100% | 0.742529 |
| 45 | N/A | N/A | 0.8004 | 0.3121 | 0.8080 | 0.7980 | N/A | 100% | 0.743381 |
| 50 | N/A | N/A | 0.8015 | 0.8090 | 0.8005 | 0.8044 | N/A | 100% | 0.744422 |
| 51 | N/A | N/A | 6.8016 | 0.8099 | 0.7937 | 6.8112 | N/A | 100% | 0.744516 |
| 52 | N/A | N/A | 0.8023 | 0.8026 | 0.8137 | 0.8084 | N/A | 101% | 0.745179 |
| 53 | N/A | N/A | 0.8044 | 0.8081 | 0.8105 | 0.8058 | N/A | 101% | 0.747166 |
| 54 | N/A | N/A | 0.8003 | 0.8065 | 0.8064 | 0.8010 | N/A | 100% | 0.743286 |
| 55 | N/A | N/A | 0.8021 | 0.8035 | 0.7997 | 0.7957 | N/A | 101% | 0.744989 |
| 56 | N/A | N/A | 0.8026 | 0.8113 | 0.8111 | 0.8045 | N/A | 101% | 0.745463 |
| 57 | N/A | N/A | 0 8031 | 0.8118 | 0.7934 | 0.8048 | N/A | 101% | 0.745936 |
| 58 | N/A | N/A | 0.8021 | 0.8098 | 0.8126 | 0.8113 | N/A | 101% | 0.744989 |
| 59 | N/A | N/A | 0.8051 | 0.8007 | 0.8117 | 0.8060 | N/A | 101% | 0.747828 |
| 60 | N/A | N/A | 0.8005 | 0.8087 | 0.8029 | 0.8030 | N/A | 100% | 0.743475 |
| 61 | N/A | N/A | 0.5028 | 0.8095 | 0.8075 | 0.8011 | N/A | 101% | 0.745652 |
| 62 | N/A | N/A | 0.8028 | 0.8043 | 0.8040 | 0.8014 | N/A | 101% | 0.745552 |
| 63 | N/A | N/A | 0.7988 | 0.8144 | 0.8027 | 0.8102 | N/A | 100% | 0.741867 |
| 64 | N/A | N/A | 0.8002 | 0.8111 | 0.8118 | 0.8084 | N/A | 100% | 0.743192 |
| 65 | N/A | N/A | 0.5016 | 0.8087 | 0.8085 | 0.8059 | N/A | 100% | 0.744516 |
| 66 | N/A | N/A | 0.8008 | 0.8048 | 0.8012 | 0.8021 | N/A | 100% | 0.743759 |
| 67 | N/A | N/A | 0.8050 | 0.8105 | 0.8115 | 0.7882 | N/A | 100% | 0.743949 |
| 68 | N/A | N/A | 0.8016 | 0.8023 | 0.7924 | 0.8002 | N/A | 100% | 0.744516 |
| 69 | N/A | N/A | 0.8031 | 0.7998 | 0.8182 | 0.8048 | N/A | 101% | 0.745936 |
| 70 | N/A | N/A | 0.8019 | 0.8161 | 0.8136 | 0.8087 | N/A | 101% | 0.7448 |
| 71 | N/A | N/A | 0.8036 | 0.8115 | 0.8104 | 0.8095 | N/A | 101% | 0.745409 |
| 72 | N/A | N/A | 0.8022 | 0.8112 | 0.8014 | 0.8042 | N/A | 101% | 0.745084 |
| 73 | N/A | N/A | 0.8025 | 0.8082 | 0.8115 | 0.8037 | N/A | 101% | 0.745358 |
| 74 | N/A | N/A | 0.8075 | 0.8030 | 0.8070 | 0.7964 | N/A | 101% | 0.750099 |
| 75 | N/A | N/A | 0.7975 | 0.8085 | 0.8182 | 0.8084 | N/A | 100% | 0.740637 |
| 76 | N/A | N/A | 0.8205 | 0.7994 | 0.8141 | 0.8074 | N/A | 102% | 0.752933 |
| 77 | N/A | N/A | 0.8048 | 0.7980 | 0.8055 | 0.8116 | N/A | 101% | 0.747544 |
| 78 | N/A | N/A | 0.8020 | 0.8106 | 0.8066 | 0.8036 | N/A | 101% | 0.744895 |
| 79 | N/A | N/A | 0.8065 | 0.8112 | 0.7946 | 0.8015 | N/A | 101% | 0.749153 |
| 80 | N/A | N/A | 0.5053 | 0.8044 | 0.8180 | 0.7986 | N/A | 101% | 0.748017 |
| 81 | N/A | N/A | 0.8061 | 0.8050 | 0.8129 | 0.8087 | N/A | 101% | 0.748/74 |
| 82 | N/A | N/A | 0.8033 | 0.8059 | 0.8087 | 0.8080 | N/A | 101% | 0.746125 |

-continued

| | | | | | | | | | |
|---|---|---|---|---|---|---|---|---|---|
| 83 | N/A | N/A | 0.8037 | 0.8015 | 0.8086 | 0.8121 | N/A | 101% | 0.746503 |
| 84 | N/A | N/A | 0.8049 | 0.8131 | 0.7995 | 0.8076 | N/A | 101% | 0.747539 |
| 85 | N/A | N/A | 0.8040 | 0.8153 | 0.8015 | 0.8043 | N/A | 101% | 0.746787 |
| 86 | N/A | N/A | 0.8037 | 0.8084 | 0.8136 | 0.7978 | N/A | 101% | 0.745503 |
| 87 | N/A | N/A | 0.8034 | 0.8104 | 0.8113 | 0.8039 | N/A | 101% | 0.74622 |
| 88 | N/A | N/A | 0.8044 | 0.7998 | 0.8080 | 0.8078 | N/A | 101% | 0.747156 |
| 89 | N/A | N/A | 0.8028 | 0.8090 | 0.8045 | 0.8112 | N/A | 101% | 0.745552 |
| Max | N/A | N/A | 0.8205 | 0.8161 | 0.8182 | 0.8121 | N/A | 102% | |
| Min. | N/A | N/A | 0.7919 | 0.7980 | 0.7924 | 0.7952 | N/A | 99% | |
| Mean. | N/A | N/A | 0.8019 | 0.8073 | 0.8067 | 0.8044 | N/A | 101% | |
| Stdabw. | N/A | N/A | 0.0031 | 0.0061 | 0.0082 | 0.0046 | N/A | 0% | |

Additional 1 h interruption

| | Surrogate solution Density: 1.0729 g/mL | | Active solution Density: 1.0568 g/mL | | | | | | |
|---|---|---|---|---|---|---|---|---|---|
| No.: | Variation A [g] | Variation B [g] | Variation 1 [g] | Variation 2 [g] | Variation 3 [g] | Variation 4 [g] | Variation 5 [g] | | |
| 101 | N/A | N/A | 0.8058 | 0.8097 | 0.8023 | 0.8044 | N/A | 101% | 0.748491 |
| 102 | N/A | N/A | 0.8028 | 0.8000 | 0.8067 | 0.8030 | N/A | 101% | 0.745652 |
| 103 | N/A | N/A | 0.8061 | 0.8118 | 0.7952 | 0.8055 | N/A | 101% | 0.748774 |
| Max. | N/A | N/A | 0.8061 | 0.8118 | 0.8067 | 0.8055 | N/A | 101% | |
| Min. | N/A | N/A | 0.8028 | 0.8000 | 0.7952 | 0.8030 | N/A | 101% | |
| Mean. | N/A | N/A | 0.8049 | 0.8072 | 0.8014 | 0.8043 | N/A | 101% | |
| Stdabw. | N/A | N/A | 0.0018 | 0.0063 | 0.0058 | 0.0013 | N/A | 0% | 0.752938 |
| | | | | | | | | | 0.735338 |

Standard Deviation of Fill

| | Variation 1 (g) | Variation 2 (g) | Variation 3 (g) | Variation 4 (g) | Variation 5 (g) |
|---|---|---|---|---|---|
| Calibration | 0.07326842 | 0.018758829 | 0.01633971 | 0.015712214 | 0.032577593 |
| Weight Check | 1.0 | 4.5 | 5.7 | 4.3 | 4.987025271 |
| Interrupt Study | 3.1 | 6.1 | 8.2 | 4.6 | N/A |
| WC & IS Combined | 0.002857078 | 0.004737287 | 0.006603712 | 0.004699877 | 0.004987025 |
| 1h Interrupt (n = 3) | 0.0018 | 0.0063 | 0.0058 | 0.0013 | N/A |

What is claimed is:

1. A filling system, comprising:

a reservoir holding a filling fluid for distribution; and at least one filling nozzle fluidly coupled to the reservoir to distribute the filling fluid through a nozzle opening, wherein at least one set of operating parameters defines a nozzle radius (r), a filling fluid density differential (ρ), a fluid surface tension differential (γ), and a net acceleration (a) to form a stable fluid interface in the filling fluid adjacent to the nozzle opening after the filling fluid is distributed from the at least one filling nozzle, the stable fluid interface having a static interface and/or a controlled plug volume, wherein the filling system generates, based at least partially on at least one fluid property, the at least one set of operating parameters for distributing the filling fluid through the nozzle opening, wherein the at least one fluid property includes a fluid viscosity, and wherein a stable jet of filling fluid is distributed through the at least one nozzle opening and does not break during filling in a time calculated as $$\cong \sqrt{\frac{\rho r^3}{\gamma}}.$$

2. The system of claim 1, wherein the nozzle radius, the filling fluid, the density differential, the fluid surface tension differential, and the net acceleration are defined to satisfy the equation $((\rho*a*r^2)/\gamma)<0.842$.

3. The system of claim 1, wherein the filling fluid has a fluid profile that minimizes mass loss due to convective drying within the at least one filling nozzle when the stable fluid interface is formed.

4. The system of claim 1, wherein the net acceleration is the acceleration of gravity.

5. The system of claim 1, wherein the at least one filling nozzle is a filling needle.

6. The system of claim 5, wherein the filling needle comprises stainless steel.

7. The system of claim 1, further comprising:

a pump fluidly coupled to the reservoir to distribute the filling fluid through the nozzle opening.

8. The system of claim 7, further comprising:

a processor operatively coupled to the pump and configured to maintain a fluid interface with a stable resting profile by adjusting at least one pump parameter of the pump.

9. The system of claim 8, further comprising:

a nozzle actuator coupled to the at least one filling nozzle and operatively coupled to the processor, the processor configured to maintain the fluid interface with the stable resting profile by adjusting at least one actuator parameter of the nozzle actuator.

10. The system of claim 1, wherein the at least one filling nozzle defines a first radius and a second radius that is smaller than the first radius, the at least one filling nozzle having a narrowed portion with the second radius that is formed between the nozzle opening and a body of the at least one filling nozzle, the body and the nozzle opening of the at least one filling nozzle having the first radius.

11. The system of claim 3, wherein the stable fluid interface is retracted from the opening of the filling nozzle.

12. The system of claim 1, wherein the filling fluid comprises a liquid formulation of antibody A.

13. The system of claim 1, wherein the at least one set of operating parameters further comprises a contact angle between the at least one nozzle and the filling fluid.

14. The system of claim 13, wherein the contact angle is less than 90 degrees.

15. The system of claim 7, wherein the at least one set of operating parameters includes a reverse flow velocity of the pump, wherein the reverse flow velocity is chosen to satisfy a Modified Taylor's Law equation of $$\frac{h}{r} = \frac{1.34 * Ca^{2/3}}{1 + 1.34 * 2.5Ca^{2/3}}$$

such that h/r is less than a predetermined maximum value, wherein h/r is a formed film thickness divided by a radius of the nozzle opening and Ca is equal to (the fluid viscosity (μ) of the filling fluid* the reverse flow velocity, V)/a fluid surface tension (γ) of the filling fluid relative to a surrounding environment fluid.

16. The system of claim 15, wherein the reverse flow velocity satisfies the Modified Taylor's Law equation so that h/r is less than 0.10.

17. The system of claim 7, wherein the at least one set of operating parameters is generated to produce an Ohnesorge number that results in the stable jet of filling fluid being distributed through the nozzle opening and down to a bottom of a filling vessel.

18. The system of claim 7, wherein the at least one set of operating parameters enables control of the pump to fill at least one container with the filling fluid.

19. The system of claim 1, wherein the at least one set of operating parameters is generated such that a bubble forms in the filling fluid within the at least one nozzle at the stable fluid interface.

20. A filling system, comprising:

a reservoir holding a filling fluid for distribution;

at least one filling nozzle fluidly coupled to the reservoir to distribute the filling fluid through a nozzle opening, wherein at least one set of operating parameters defines a nozzle radius (r), a filling fluid density differential (ρ), a fluid surface tension differential (γ), and a net acceleration (a) to form a stable fluid interface in the filling fluid adjacent to the nozzle opening after the filling fluid is distributed from the at least one filling nozzle, the stable fluid interface having a static interface and/or a controlled plug volume, wherein the filling system generates, based at least partially on at least one fluid property, the at least one set of operating parameters for distributing the filling fluid through the nozzle opening, wherein the at least one fluid property includes a fluid viscosity;

a pump fluidly coupled to the reservoir to distribute the filling fluid through the nozzle opening; and a processor operatively coupled to the pump and configured to maintain the stable fluid interface by adjusting at least one pump parameter of the pump, wherein a stable jet of filling fluid is distributed through the at least one nozzle opening and does not break during filling in a time calculated as $$\cong \sqrt{\frac{\rho r^3}{\gamma}}.$$

21. The system of claim 20, wherein the at least one set of operating parameters further comprises a material of the at least one nozzle and a contact angle between the at least one nozzle and the filling fluid for controlling distribution of the filling fluid through the nozzle opening.

22. The system of claim 20, wherein the time maximizes liquid velocity.

23. The system of claim 20, wherein the filling fluid comprises a liquid formulation of antibody A.

24. The system of claim 23 wherein the system is configured to generate (or satisfy) at least one of a stable resting profile, a stable retracting profile and a stable flowing profile.

25. A filling system, comprising:

a reservoir holding a filling fluid for distribution; and at least one filling nozzle fluidly coupled to the reservoir to distribute the filling fluid through a nozzle opening, wherein at least one set of operating parameters defines a nozzle radius (r), a filling fluid density differential (ρ), a fluid surface tension differential (γ), and a net acceleration (a) to form a stable fluid interface in the filling fluid adjacent to the nozzle opening after the filling fluid is distributed from the at least one filling nozzle, the stable fluid interface having a static interface and/or a controlled plug volume, wherein the filling system generates, based at least partially on at least one fluid property, the at least one set of operating parameters for distributing the filling fluid through the nozzle opening, wherein the at least one fluid property includes a fluid viscosity, and wherein the at least one set of operating parameters is generated such that a bubble forms in the filling fluid within the at least one nozzle at the stable fluid interface.

* * * * *